US007591238B2

(12) United States Patent
Tateno et al.

(10) Patent No.: US 7,591,238 B2
(45) Date of Patent: Sep. 22, 2009

(54) VARIABLE VALVE-OPERATING DEVICE

(75) Inventors: Manabu Tateno, Sunto-gun (JP); Shuichi Ezaki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 191 days.

(21) Appl. No.: 11/908,850

(22) PCT Filed: May 9, 2006

(86) PCT No.: PCT/JP2006/309625

§ 371 (c)(1),
(2), (4) Date: Sep. 17, 2007

(87) PCT Pub. No.: WO2006/121181

PCT Pub. Date: Nov. 16, 2006

(65) Prior Publication Data

US 2009/0025666 A1 Jan. 29, 2009

(30) Foreign Application Priority Data

May 11, 2005 (JP) ..... 2005-138552

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS

| | | | | |
|---|---|---|---|---|
| 5,474,037 | A | 12/1995 | Paul | |
| 2004/0118369 | A1 * | 6/2004 | Naumann | 123/90.16 |

FOREIGN PATENT DOCUMENTS

| | | |
|---|---|---|
| DE | 199 60 742 | 6/2001 |
| EP | 0 717 174 | 6/1996 |
| EP | 1 111 205 | 6/2001 |
| EP | 1 247 945 | 10/2002 |
| EP | 1 526 256 | 4/2005 |
| FR | 2 861 130 | 4/2005 |
| JP | 2004 100555 | 4/2004 |

* cited by examiner

*Primary Examiner*—Zelalem Eshete
(74) *Attorney, Agent, or Firm*—Oblon, Spivak, McClelland, Maier & Neustadt, L.L.P.

(57) ABSTRACT

The rotary motion of a camshaft is transmitted from a first drive cam to a slide surface of a swing cam arm via intermediate members so that the swing cam arm lifts a valve. In this instance, the operating characteristic of the valve changes when the rotation position of a control shaft changes to change the positions of the intermediate members on the slide surface. When the operating characteristic control mode for the valve is to be changed from variable control to fixed control, coupling means couples the swing cam arm and input arm, thereby causing a second drive cam to swing the swing cam arm. The setting for the lift amount of the valve that is obtained when the second drive cam swings the swing cam arm is not smaller than a maximum lift amount setting for a situation where the first drive cam swings the swing cam arm.

8 Claims, 15 Drawing Sheets

Valve opening
Valve closing
50
20
22
58
60
46
40
42b
52
62
32
34
30
42a
12
10
6
2
4

Lift difference
20
22
50
58
60
62
P1
P2
P3
40
42b
46
52
34
32
30
42a
12
10
6
2
4

VARIABLE VALVE-OPERATING DEVICE

TECHNICAL FIELD

The present invention relates to a variable valve-operating device for an internal combustion engine, and more particularly to a variable valve-operating device that is capable of mechanically changing the operating characteristic of a valve.

BACKGROUND ART

A known conventional variable valve-operating device disclosed, for instance, by Japanese Patent Laid-open No. 2004-100555 mechanically changes the valve lift amount and valve timing in accordance with the operation of an internal combustion engine.

In the variable valve-operating device disclosed by Japanese Patent Laid-open No. 2004-100555, a camshaft is provided with two rotary cams, and a first rotary cam opens/closes a first intake valve of two intake valves positioned in a cylinder whereas a second rotary cam opens/closes a second intake valve. A variable valve transmission mechanism, which comprises a four-bar linkage, is positioned between the first rotary cam and first intake valve and between the second rotary cam and second intake valve.

The four-bar linkage for the above variable valve-operating device comprises an input arm, which has an input section that comes into contact with a rotary cam; a transmission arm, which is coupled to the input arm in a swingable manner; a swing arm, which is coupled to the transmission arm in a swingable manner, is capable of swinging around a rotary control shaft, and transmits a driving force, which is transmitted from a rotary cam, to an output section that opens/closes an intake valve; and a control arm, which rotates around the rotary control shaft and is coupled to the input arm in a swingable manner. The operating characteristic of an intake valve can be mechanically changed by controlling the attitude of the four-bar linkage to change the positional relationship between a rotary cam and input section.

Further, the above variable valve-operating device includes a coupling mechanism, which couples the four-bar linkage (first linkage) for the first intake valve to the four-bar linkage (second linkage) for the second intake valve, and a mechanism for maintaining the second linkage's attitude for providing the maximum operating angle of the second intake valve when the first and second linkages are uncoupled. The coupling mechanism comprises a through-hole, which is formed in the control arm of each four-bar linkage, and a coupling pin, which is to be inserted into the through-hole. The mechanism for maintaining the second linkage's attitude at the time of uncoupling comprises a through-hole that is formed in a stationary plate, a through-hole that is formed in the control arm (second control arm) of the second linkage, and the above-mentioned coupling pin.

The coupling pin is constantly engaged with the through-hole in the second control arm. The coupling pin can move toward the control arm (first control arm) of the first linkage and toward the stationary plate while it is engaged with the through-hole in the second control arm. When the coupling pin moves toward the first control arm and becomes inserted into the through-hole in the first control arm, the second control arm is coupled to the first control arm via the coupling pin. When the control arms are coupled, the first and second linkages assume the same attitude at all times. In this instance, control can be exercised so that the first and second valves have the same operating characteristic.

On the contrary, when the coupling pin moves toward the stationary plate and becomes inserted into the through-hole in the stationary plate, the second control arm is coupled to the stationary plate via the coupling pin. When the second control arm and stationary plate are coupled, the attitude of the second linkage is fixed. When the attitude of the first linkage is controlled to change the positional relationship between a rotary cam and input section, only the operating characteristic of the first valve can be mechanically changed with the operating characteristic of the second valve remaining unchanged.

In other words, the above variable valve-operating device can selectively provide the first and second intake valves with the same operating characteristic or with different operating characteristics. In this manner, the operating characteristics of the first and second intake valves, particularly, the lift amounts of these valves, can be rendered different from each other. Therefore, different intake flow rates can be employed to invoke a swirling flow within a combustion chamber. This makes it possible to provide stable combustion in the combustion chamber.

DISCLOSURE OF THE INVENTION

As described above, the second intake valve can control its operating characteristic in two different modes. In a variable control mode, the operating characteristic varies with the rotation position of the rotary control shaft. In a fixed control mode, on the other hand, a great operating angle is constantly employed without regard to the rotation position of the rotary control shaft. However, when the operating characteristic control mode for the second intake valve is to be changed from variable control to fixed control, it is necessary to perform two operations. More specifically, it is necessary to extract the coupling pin from the through-hole in the first control arm and insert the coupling pin into the through-hole in the stationary plate. Similarly, when the mode is to be changed from fixed control to variable control, it is necessary to perform two operations. More specifically, it is necessary to extract the coupling pin from the through-hole in the stationary plate and insert the coupling pin into the through-hole in the first control arm.

To perform the above two operations smoothly, it is preferred that the positions of the through-hole in the first control arm, the coupling pin, and the through-hole in the stationary plate agree perfectly with each other when the operating characteristic control mode changes. However, such perfect positional agreement cannot easily be achieved from the viewpoint of machining accuracy. Even if perfect positional agreement is achieved due, for instance, to simultaneous machining, distortion may occur during an actual operation. In addition, such positional agreement is also affected, for instance, by the control accuracy of the rotary control shaft. In reality, therefore, it is difficult to precisely align the positions of the through-holes and coupling pin.

Further, while the above two operations are sequentially performed, the coupling pin is disengaged from the first control arm and from the stationary plate for a brief moment. In this instance, the second control arm is free. Therefore, if any external force is applied, the position of the second control arm around the rotary control shaft may change, thereby displacing the coupling pin from a through-hole targeted for coupling.

The present invention has been made in view of the above circumstances. It is an object of the present invention to provide a variable valve-operating device that is capable of changing the operating characteristic control mode from variable control to fixed control or from fixed control to variable control through the use of a simple structure, and making such a mode change without malfunction.

In accomplishing the above object, according to a first aspect of the present invention, there is provided a variable valve-operating device comprising: a valve positioned on an intake side or on an exhaust side of an internal combustion engine; a first drive cam installed over a camshaft; a control shaft positioned parallel with the camshaft and being capable of changing the rotation position continuously or stepwise; a swing cam arm installed over the control shaft in a rotatable manner to swing around the control shaft; a swing cam surface formed on the swing cam arm and coming into contact with a valve support member, which supports the valve, to push the valve in a lifting direction; a slide surface formed on a swing member to face the first drive cam; an intermediate member sandwiched between the first drive cam and the slide surface, and coming into contact with a circumferential surface of the first drive cam; pushing means for pushing the swing cam arm in the circumferential direction of the control shaft so as to press the slide surface against the intermediate member; an interlock mechanism for moving the intermediate member along the circumferential surface of the first drive cam in coordination with the rotation of the control shaft to change the position of the intermediate member in relation to the center of the camshaft; a second drive cam installed over the camshaft so as to be aligned with the first drive cam; an input arm installed over the control shaft in a rotatable manner, positioned adjacent to the swing cam arm, and swinging upon receipt of a driving force input from the second drive cam; and coupling means for coupling the swing cam arm to the input arm.

While the swing cam arm is uncoupled from the input arm, the first aspect of the present invention transmits the rotary motion of the camshaft from the first drive cam to the slide surface of the swing cam arm via the intermediate member. Further, the rotary motion is transmitted from the swing cam arm to the valve. When the rotation position of the control shaft is changed, the rotation of the control shaft is transmitted to the intermediate member via the interlock mechanism. The intermediate member moves along the circumferential surface of the first drive cam while it is sandwiched between the first drive cam and slide surface. When the position of the intermediate member changes in relation to the camshaft, the position of the intermediate member on the slide surface changes. This causes the swing angle and initial swing position of the swing cam arm to change, thereby changing the valve lift amount. Further, when the position of the intermediate member changes in relation to the camshaft, the swing timing of the swing member changes in relation to the rotation of the camshaft. This causes the valve timing to change.

Meanwhile, when the coupling means couples the swing cam arm to the input arm, the rotary motion of the camshaft is transmitted from the second drive cam to the swing cam arm via the input arm. Further, the rotary motion is transmitted from the swing cam arm to the valve. The valve's operating characteristic prevailing in this instance is mechanically determined by the shapes of the second drive cam, input arm, and swing cam arm and by the positional relationship among them. A constant operating characteristic is maintained without regard to the rotation position of the control shaft.

As described above, according to the first aspect of the present invention, the operating characteristic control mode for the valve can be switched from variable control to fixed control simply by allowing the coupling means to couple the swing cam arm and input arm. Further, the operating characteristic control mode for the valve can be switched from fixed control to variable control simply by uncoupling the swing cam arm and input arm.

According to a second aspect of the present invention, there is provided the variable valve-operating device as described in the first aspect, wherein a setting for the lift amount of the valve that is obtained when the second drive cam swings the swing cam arm while the swing cam arm and the input arm are coupled by the coupling means is not smaller than a maximum lift amount setting for a situation where the first drive cam swings the swing cam arm.

When the coupling means couples the swing cam arm and input arm, the second aspect of the present invention generates a valve lift amount that is not smaller than the maximum lift amount for causing the first drive cam to swing the swing cam arm. Therefore, the swing cam arm that is swinging does not interfere with the intermediate member.

According to a third aspect of the present invention, there is provided the variable valve-operating device as described in the first or second aspect, wherein the coupling means couples the swing cam arm and the input arm when an insertable pin provided for either the swing cam arm or the input arm is inserted into a pin hole in the mating arm; and wherein the positions of the pin hole and the pin coincide with each other when the control shaft rotates beyond a normal use range and toward a great lift side in a situation where the swing cam arm and the input arm are not coupled.

According to the third aspect of the present invention, the swing cam arm and input arm can be coupled by using a simple structure in which the pin is to be inserted into the pin hole. When the rotation position of the control shaft is within the normal use range, the position of the pin hole does not coincide with that of the pin. Therefore, the valve does not erroneously switch to a fixed operation while it is performing a variable operation. Further, the influence of a lift amount difference upon the intake air amount decreases with an increase in the lift amount. Therefore, even when the control shaft is rotated beyond the normal use range and toward a great lift side to move the intermediate member toward a great lift side for valve operation change purposes, the intake air amount does not significantly change.

According to a fourth aspect of the present invention, there is provided the variable valve-operating device as described in the third aspect, wherein the positions of the pin hole and the pin coincide with each other while the swing cam arm is a zero lift position in which the valve does not lift.

According to the fourth aspect of the present invention, the pin is inserted into the pin hole while the swing cam arm is in a zero lift position in which the valve is not lifted. Therefore, the pin can be properly inserted into the pin hole. This makes it possible to properly change the operating characteristic control mode from variable control to fixed control.

According to a fifth aspect of the present invention, there is provided the variable valve-operating device as described in the first or second aspect, wherein the coupling means couples the swing cam arm and the input arm when an insertable pin provided for either the swing cam arm or the input arm is inserted into a pin hole in the mating arm; and wherein the position of the pin can be aligned with the position of the pin hole while a driving force for the pin, which is supplied to the pin before coupling of the swing cam arm and the input arm, is maintained.

According to the fifth aspect of the present invention, a driving force is supplied to the pin before a change in the operating characteristic control mode. Therefore, when the position of the pin coincides with that of the pin hole, the pin is immediately inserted into the pin hole. This makes it possible to properly change the operating characteristic control mode from variable control to fixed control.

According to a sixth aspect of the present invention, there is provided the variable valve-operating device as described in the fifth aspect, further comprising: an oil path for supplying drive hydraulic oil to the pin provided in the control shaft; and a discharge valve for discharging the hydraulic oil from the oil path; wherein the oil path doubles as a lubricating oil path for supplying lubricating oil between the control shaft and the swing cam arm and/or the input arm; and wherein the discharge valve is normally closed, opened when the pin is extracted from the pin hole to uncouple the swing cam arm and the input arm, and closed again when the position of the pin is displaced from the position of the pin hole.

According to the sixth aspect of the present invention, the lubricating oil path can double as the hydraulic oil path. Therefore, the oil path configuration for the entire device can be simplified. Further, according to the sixth aspect of the present invention, the pin can be extracted from the pin hole when the discharge valve is opened to discharge the hydraulic oil from the oil path and decrease the hydraulic pressure applied to the pin. Furthermore, the driving force of the pin can be retained for subsequent coupling when the discharge valve is closed to increase the hydraulic pressure applied to the pin.

According to a seventh aspect of the present invention, there is provided the variable valve-operating device as described in the fifth aspect, further comprising: an oil path for supplying drive hydraulic oil to the pin provided in the control shaft; and an open/close valve for opening/closing the oil path; wherein the open/close valve is normally closed, opened when the pin is inserted into the pin hole to couple the swing cam arm and the input arm, and closed again when the pin is extracted from the pin hole to uncouple the swing cam arm and the input arm.

According to the seventh aspect of the present invention, the driving force for lodging the pin in the pin hole can be supplied when the open/close valve opens to increase the hydraulic pressure applied to the pin. Further, the pin can be extracted from the pin hole when the open/close valve closes to decrease the hydraulic pressure applied to the pin. Furthermore, the seventh aspect of the present invention supplies the hydraulic oil to the pin only when the swing cam arm and input arm are to be coupled. Therefore, the hydraulic oil can be saved by reducing the amount of hydraulic oil leakage from a sliding gap.

In accomplishing the above object, according to a eighth aspect of the present invention, there is provided a variable valve-operating device comprising: a first valve and a second valve aligned with each other and positioned on the intake side or the exhaust side of a cylinder in an internal combustion engine; a first drive cam installed over a camshaft; a control shaft positioned parallel with the camshaft and being capable of changing the rotation position continuously or stepwise; a first swing cam arm provided for the first valve to swing around the control shaft; a second swing cam arm provided for the second valve and being capable of swinging independently of the first swing cam arm; swing cam surfaces formed on the first swing cam arm and the second swing arm, and coming into contact with a valve support member, which supports the first valve and the second valve, to push the first valve and the second valve in a lifting direction; slide surfaces formed on the first swing cam arm and the second swing cam arm to face the first drive cam; an intermediate member sandwiched between the first drive cam and the slide surfaces of the first swing cam arm and of the second swing cam arm, and coming into contact with a circumferential surface of the first drive cam; a first pushing means for pushing the first swing cam arm in the circumferential direction of the control shaft so as to press the slide surface of the first swing cam arm against the intermediate member; a second pushing means for pushing the second swing cam arm in the circumferential direction of the control shaft so as to press the slide surface of the second swing cam arm against the intermediate member; an interlock mechanism for moving the intermediate member along the circumferential surface of the first drive cam in coordination with the rotation of the control shaft to change the position of the intermediate member in relation to the center of the camshaft; a second drive cam installed over the camshaft so as to be aligned with the first drive cam; an input arm installed over the control shaft in a rotatable manner, positioned adjacent to the second swing cam arm, and swinging upon receipt of a driving force input from the second drive cam; and coupling means for coupling the second swing cam arm to the input arm.

According to the eighth aspect of the present invention, while the second swing cam arm and input arm are uncoupled, the rotary motion of the camshaft is transmitted from the first drive cam to the slide surfaces of the first and second swing cam arms via the intermediate member and converted to the swing motion of the first and second swing cam arms. The swing motion of the first swing cam arm is transmitted from its swing cam surface to the valve support member and converted to the lift motion of the first valve. The swing motion of the second swing cam arm is transmitted from its swing cam surface to the valve support member and converted to the lift motion of the second valve.

When the rotation position of the control shaft is changed, the rotation of the control shaft is transmitted to the intermediate member via the interlock mechanism. The intermediate member then moves along the circumferential surface of the first drive cam while it is sandwiched between the first drive cam and the slide surfaces of the first and second swing cam arms. When the position of the intermediate member changes in relation to the camshaft, the position of the intermediate member on the slide surfaces changes. This causes the swing angles and initial swing positions of the first and second swing cam arms to change, thereby changing the lift amounts of the first and second valves. Further, when the position of the intermediate member changes in relation to the camshaft, the swing timing of the first and second swing cam arms changes in relation to the phase of the camshaft. This invokes a change in the valve timing of the first and second valves.

Meanwhile, when the coupling means couples the second swing cam arm and input arm, the rotary motion of the camshaft is transmitted from the second drive cam to the second swing cam arm via the input arm. The swing motion of the second swing cam arm is transmitted from its swing cam surface to the valve support member and converted to the lift motion of the second valve. The second valve's operating characteristic prevailing is mechanically determined by the shapes of the second drive cam, input arm, and second swing cam arm and by the positional relationship among them. A constant operating characteristic is maintained without regard to the rotation position of the control shaft.

On the other hand, the rotary motion of the camshaft is transmitted from the first drive cam to the first swing cam arm via the intermediate member. Therefore, when the control shaft rotates, causing the position of the intermediate member to change in relation to the camshaft, the swing angle and initial swing position of the first swing cam arm change. The swing motion of the first swing cam arm is transmitted from its swing cam surface to the valve support member and converted to the lift motion of the first valve. Therefore, the operating characteristic of the first valve varies with the rotation position of the control shaft as is the case where the second swing cam arm and input arm are uncoupled.

As described above, the eighth aspect of the present invention can change the operating characteristic control mode for the second valve from variable control to fixed control simply when the coupling means couples the second swing cam arm and input arm, and change the operating characteristic control mode for the second valve from fixed control to variable control simply when the coupling means uncouples the second swing cam arm and input arm. This makes it easy to properly switch from a dual valve variable control mode, in which the operating characteristics of the first and second valves vary with the rotation position of the control shaft, to a single valve variable control mode, in which the operating characteristic of the first valve varies with the rotation position of the control shaft while the operating characteristic of the second valve is fixed. Switching from the single valve variable control mode to the dual valve variable control mode can also be made easily and properly.

According to a ninth aspect of the present invention, there is provided the variable valve-operating device as described in the eighth aspect, wherein a setting for the lift amount of the valves that is obtained when the second drive cam swings the second swing cam arm while the second swing cam arm and the input arm are coupled by the coupling means is not smaller than a maximum lift amount setting for a situation where the first drive cam swings the second swing cam arm.

According to the ninth aspect of the present invention, when the coupling means couples the second swing cam arm and input arm, the lift amount setting for the second valve is not smaller than the maximum lift amount for causing the first drive cam to swing the second swing cam arm. Therefore, the second swing cam arm that is swinging does not interfere with the intermediate member.

BEST MODE FOR CARRYING OUT THE INVENTION

First Embodiment

A first embodiment of the present invention will now be described with reference to FIGS. 1 to 15.

[Configuration of a Variable Valve-operating Device According to the First Embodiment]

Figure 1:
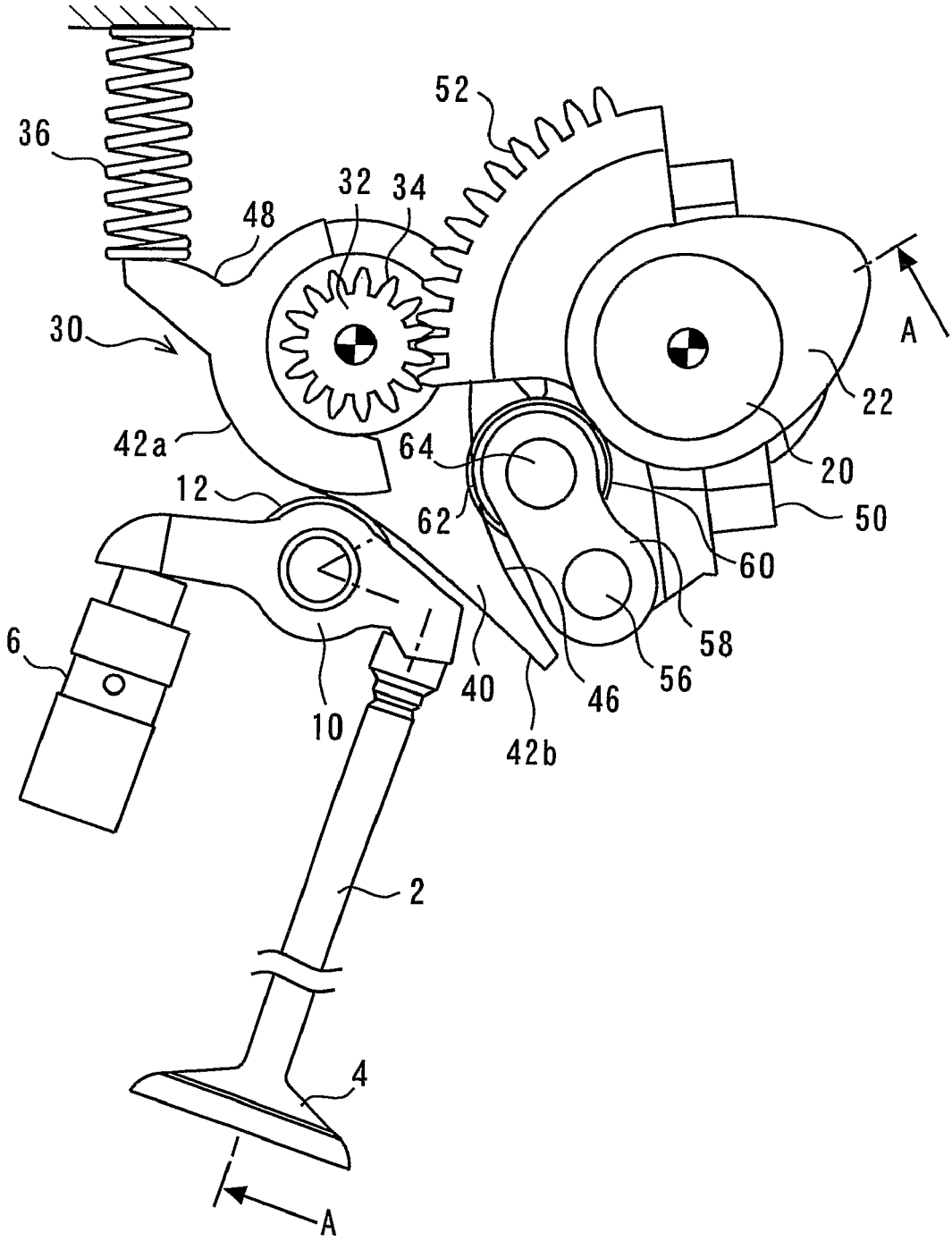
FIG. 1 is a side view illustrating the configuration of a variable valve-operating device according to a first embodiment of the present invention.
Figure 2:
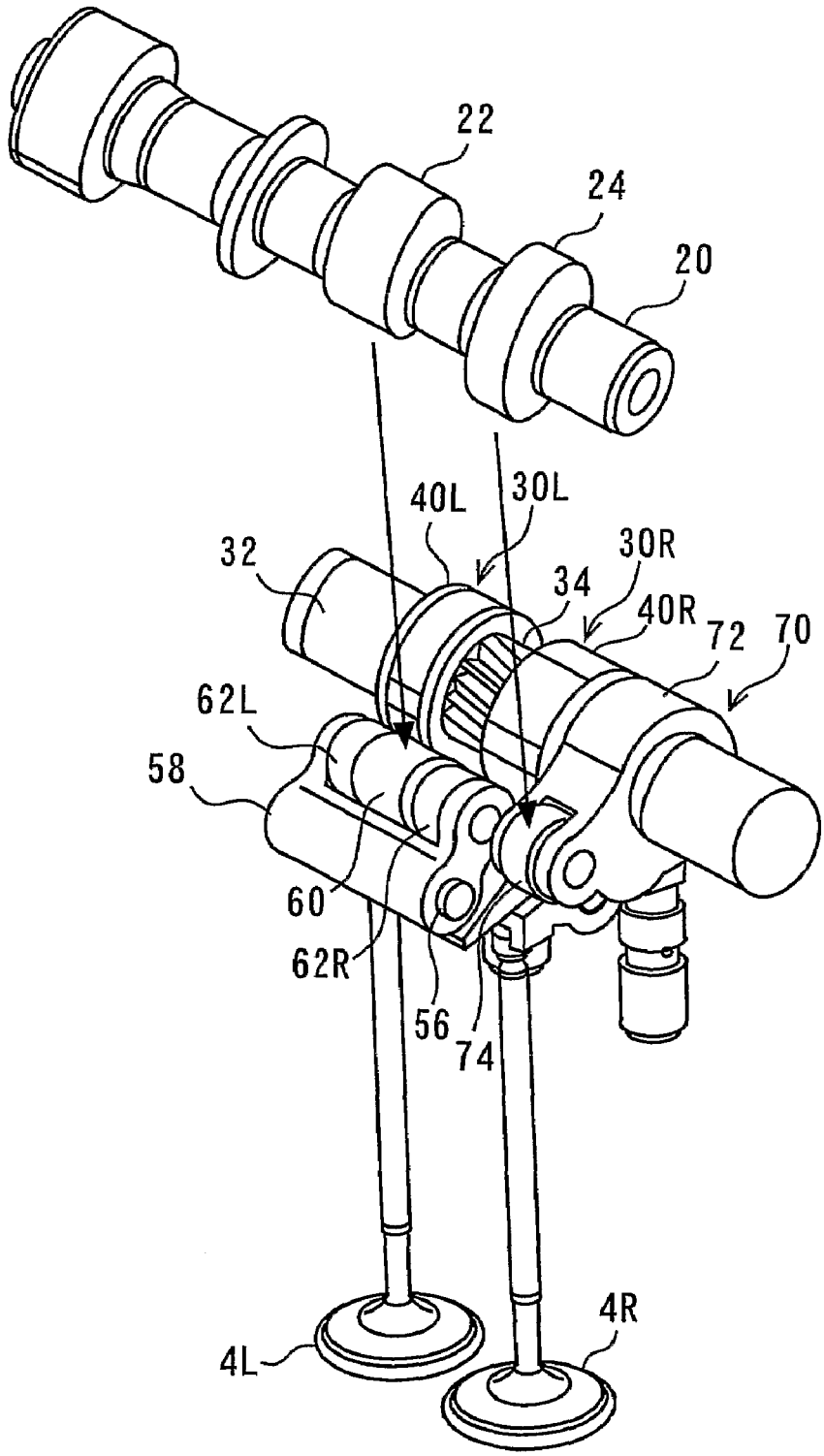
FIG. 2 is an exploded perspective view illustrating a variable valve mechanism and fixed valve mechanism in the variable valve-operating device shown in FIG. 1.
Figure 3:
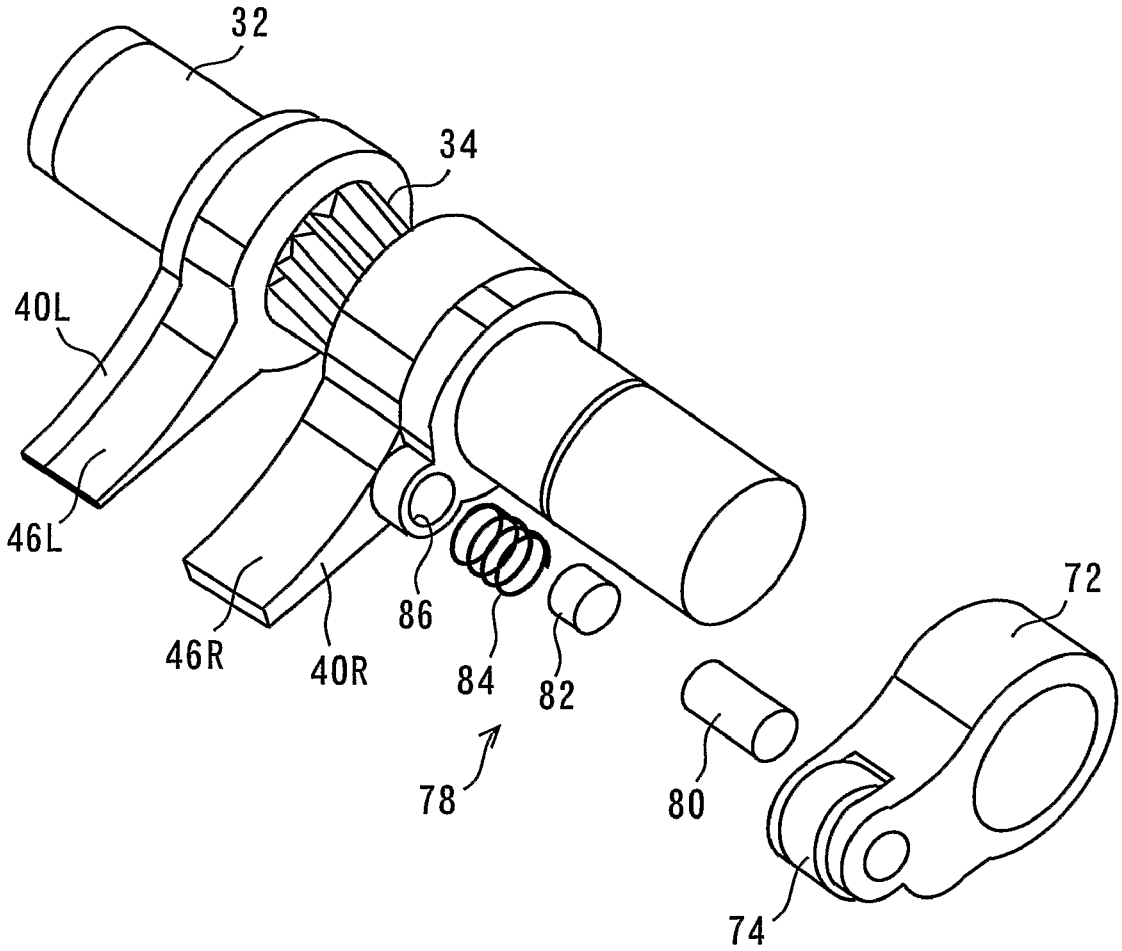
FIG. 3 is an exploded perspective view illustrating the configuration of an arm coupling mechanism in the variable valve-operating device shown in FIG. 1.
Figure 4:
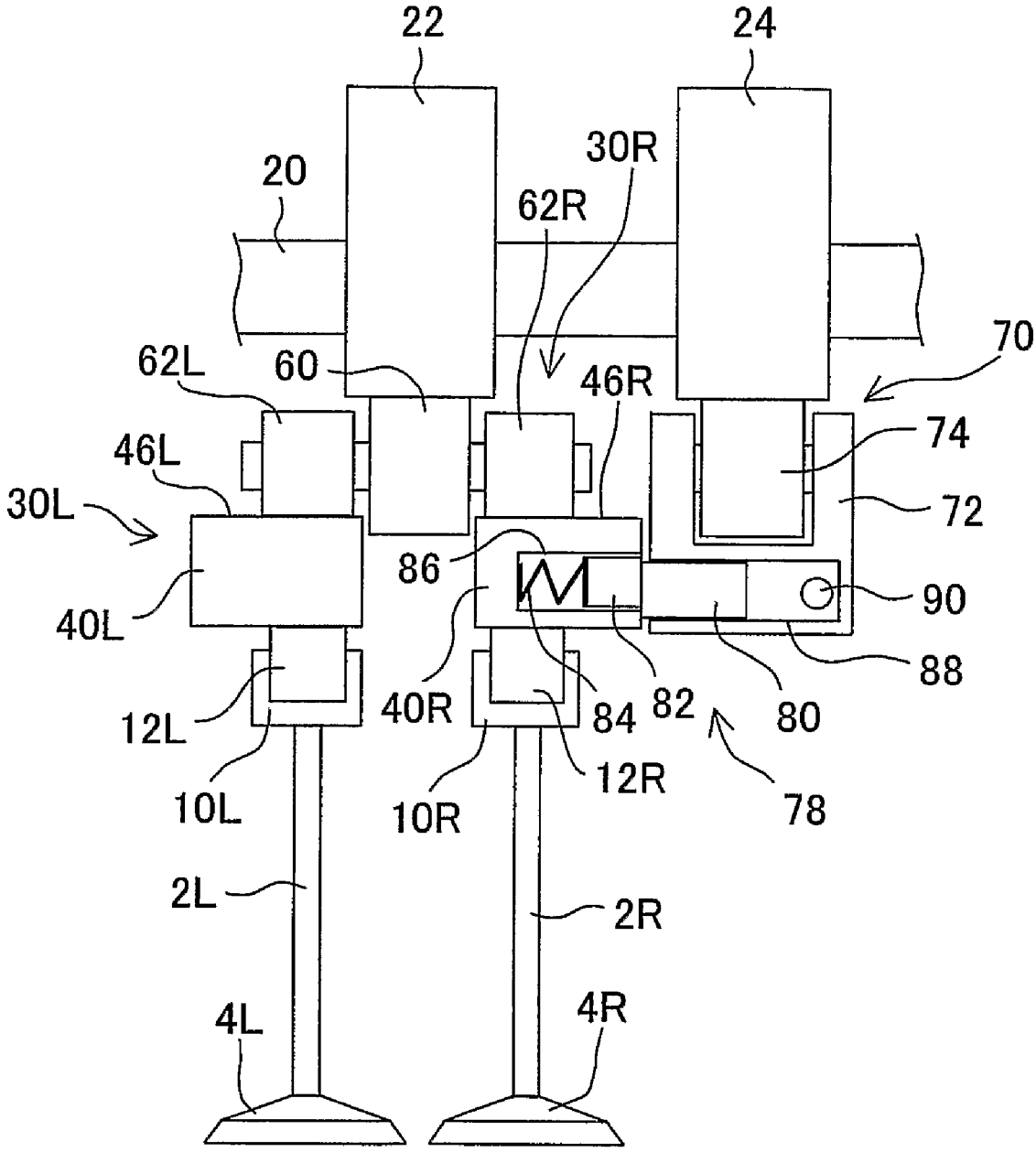
FIG. 4 is a schematic cross-sectional view that is taken along section A-A of FIG. 1 to illustrate the variable valve mechanism.

FIG. 1 is a side view illustrating the configuration of a variable valve-operating device according to the first embodiment of the present invention. FIGS. 2 and 3 are exploded perspective views illustrating the variable valve-operating device. FIG. 4 is a schematic cross-sectional view that is taken along section A-A of FIG. 1. As indicated in FIGS. 2 and 4, a camshaft 20 of the variable valve-operating device has two drive cams 22, 24 per cylinder. Two valves 4L, 4R are symmetrically positioned on the right- and left-hand sides of a drive cam (first drive cam) 22. These valves 4L, 4R are arranged on either the intake side or exhaust side of a cylinder. Variable valve mechanisms 30L, 30R are respectively provided between the first drive cam 22 and the valves 4L, 4R to interlock the lift motion of the valves 4L, 4R with the rotary motion of the first drive cam 22. Another drive cam (second drive cam) 24 is positioned so that the second valve 4R is sandwiched between the first drive cam 22 and second drive cam 24. A fixed valve mechanism 70 is provided between the second drive cam 24 and second valve 4R to interlock the lift motion of the second valve 4R with the rotary motion of the second drive cam 24. The variable valve-operating device makes it possible to select either the variable valve mechanism 30R or fixed valve mechanism 70 as the mechanism with which the lift motion of the second valve 4R is to be interlocked.

(1) Details of Variable Valve Mechanism Configuration

The configurations of the variable valve mechanisms 30L, 30R will now be described in detail. Since the right- and left-hand variable valve mechanisms 30L, 30R are basically symmetrical with respect to the first drive cam 22, their configuration will be described without distinguishing between the right- and left-hand variable valve mechanisms 30L, 30R. This document and the accompanying drawings use the term "variable valve mechanism 30" when the right- and left-hand variable valve mechanisms 30L, 30R are not distinguished from each other. Similarly, symmetrically arranged parts such as the valves 4R, 4L and the components of the variable valve mechanisms 30L, 30R are assigned reference numerals without the symbols R and L except when the right- and left-hand parts particularly need to be distinguished from each other.

In the variable valve-operating device, the valve 4 is supported by a rocker arm 10 as shown in FIG. 1. The variable valve mechanism 30 is positioned between the first drive cam 22 and rocker arm 10 to continuously vary the interlock between the rotary motion of the first drive cam 22 and the swing motion of the rocker arm 10.

The variable valve mechanism 30 includes a control arm 50, which is supported by the camshaft 20 in a rotatable manner. An intermediate arm 58 is attached to the control arm 50 in a rotatable manner. The intermediate arm 58 is placed at a position that is displaced from the center of the camshaft 20 on which the control arm 50 turns. The intermediate arm 58 has a connection pin 56, which is positioned across both ends of the fulcrum side of the intermediate arm 58. The connection pin 56 is supported by the control arm 50 in a rotatable manner. The leading end of the intermediate arm 58 is positioned toward a control shaft 32 with the connection pin 56 used as a fulcrum. A coupling shaft 64, which is positioned in parallel with the camshaft 20, is fastened to the leading end of the intermediate arm 58. A first roller 60 and second rollers 62 are supported by the coupling shaft 64 in a rotatable manner. The second rollers 62 have a smaller diameter than the first roller 60. As shown in FIG. 2, a pair of second rollers 62 are positioned on both sides of the first roller 60. A pair of control arms 50 are positioned on both sides of the first drive cam 22. The right- and left-hand control arms 50 support the intermediate arm 58 (a front control arm 50 is not shown in FIG. 1).

An arced, large-diameter gear 52 is positioned between the right- and left-hand control arms 50. The large-diameter gear 52 is fastened on both sides thereof to the right- and left-hand control arms 50. The large-diameter gear 52 is formed around the rotation center of the control arms 50, that is, along an arc that is concentric with the camshaft 20. The position of the large-diameter gear 52 on the control arms 50 is virtually opposite the position of the connection pin 56 with respect to the turning center of the control arms 50.

The variable valve mechanism 30 includes the control shaft 32, which is positioned in parallel with the camshaft 20. The rotation position of the control shaft 32 can be arbitrarily controlled by an actuator (e.g., a motor), which is not shown but functions as a control shaft drive device. A small-diameter gear 34, which is concentric with the control shaft 32, is formed on the outer circumference of the control shaft 32. The small-diameter gear 34 meshes with the large-diameter gear 52, which is mounted on the control arm 50. Therefore, the rotation of the control shaft 32 is input to the control arm 50 via the small-diameter gear 34 and large-diameter gear 52. The small-diameter gear 34 and large-diameter gear 52 constitute a speed reduction mechanism that decelerates the rotation of the control shaft 32 and transmits the decelerated rotation to the control arm 50.

Swing cam arms 40 are supported by the control shaft 32 in a swingable manner. A pair of swing cam arms 40 are positioned on both sides of the small-diameter gear 34 as shown in FIGS. 2 to 4. The swing cam arm (first swing cam arm) 40L that is positioned to the left of the small-diameter gear 34 is a component part of the variable valve mechanism 30L. The swing cam arm (second swing cam arm) 40R that is positioned to the right of the small-diameter gear 34 is a component part of the variable valve mechanism 30R. These swing cam arms 40 are arranged so that their leading ends are directed upstream in the rotation direction of the first drive cam 22. In the present embodiment, the camshaft 20 rotates clockwise as indicated by an arrow in the figure. A slide surface 46, which comes into contact with the second rollers 62 described later, is formed on the side that opposes the first drive cam 22 for the swing cam arm 40. The slide surface 46 is gradually curved toward the first drive cam 22. Further, the distance of the slide surface 46 from the center of the first drive cam 22 increases with an increase in the distance from the center of the control shaft 32, which is the swing center.

A swing cam surface 42 (42*a*, 42*b*) is formed opposite with the slide surface 46 of the swing cam arm 40. The swing cam surface 42 comprises a non-operating surface 42*a* and an operating surface 42*b*, which have different profiles. The non-operating surface 42*a* is a circumferential surface of a cam base circle and formed in such a manner that the distance from the center of the control shaft 32 is uniform. On the other hand, the operating surface 42*b* is provided at the leading end of the swing cam arm 40. It is connected to the non-operating surface 42*a* smoothly and in a continuous manner, and formed so that the distance from the center of the control shaft 32 (that is, the cam height) gradually increases with a decrease in the distance to the leading end of the swing cam arm 40. This document simply uses the term "swing cam surface 42" when the non-operating surface 42*a* and operating surface 42*b* are not distinguished from each other.

A spring seat 48 is formed on the swing cam arm 40. A lost motion spring 36 is hooked at its one end onto the spring seat 48. The lost motion spring 36 is fastened at the other end to a stationary part of the internal combustion engine. The swing cam arm 40 is pushed in such a manner that the spring force received from the lost motion spring 36 rotates the slide surface 46 toward the first drive cam 22 (counterclockwise in FIG. 1).

The intermediate arm 58 is positioned between the first drive cam 22 and the slide surface 46 of the swing cam arm 40 so as to direct its leading end toward the control shaft 32. The first roller 60, which is supported by the intermediate arm 58 in a rotatable manner, is positioned in the rotation plane of the first drive cam 22. The left-hand second roller 62L is positioned in the swing plane of the left-hand swing cam arm 40L. The right-hand second roller 62R is positioned in the swing plane of the right-hand swing cam arm 40R. The spring force of the aforementioned lost motion spring 36 works to press the slide surface 46 against the second rollers 62 and press the first roller 60, which is coupled to the second rollers 62 via the coupling shaft 64, against the first drive cam 22. Consequently, the first roller 60 and second rollers 62 are sandwiched between the slide surface 46 and first drive cam 22 for positioning purposes.

As described above, the first roller and second rollers 62 are connected to the control arm 50 via the intermediate arm 58, and sandwiched between the slide surface 46 and first drive cam 22. Therefore, when the control arm 50 rotates around the camshaft 20, the first roller 60 and second rollers 62 rotate around the camshaft 20 while maintaining contact with the circumferential surface of the first drive cam 22. Since the rotation of the control arm 50 is interlocked with the rotation of the control shaft 32 via the small-diameter gear 34 and large-diameter gear 52, the rotations of the first roller 60 and second rollers 62 around the camshaft 20 are also interlocked with the rotation of the control shaft 32. In the present embodiment, the small-diameter gear 34, large-diameter gear 52, control arm 50, and intermediate arm 58 constitute an interlock mechanism that moves the first roller 60 and second rollers 62, which are intermediate members, along the circumferential surface of the first drive cam 22 in coordination with the rotation of the control shaft 32.

The aforementioned rocker arm 10 is positioned below the swing cam arm 40. The rocker arm 10 is provided with a rocker roller 12, which faces the swing cam surface 42 of the swing cam arm 40. The rocker roller 12 is mounted on the middle part of the rocker arm 12 in a rotatable manner. A valve shaft 2 is mounted on one end of the rocker arm 10 to support the valve 4. The other end of the rocker arm 10 is supported by a hydraulic lash adjuster 6 in a rotatable manner. A valve spring (not shown) pushes the valve shaft 2 in a closing direction, that is, in the direction of pushing the rocker arm 10 upward. Such a pushing force and the force exerted by the hydraulic lash adjuster press the rocker roller 12 against the swing cam surface 42 of the swing cam arm 40.

(2) Details of Fixed Valve Mechanism Configuration

The configuration of the fixed valve mechanism 70 will now be described in detail.

As shown in FIGS. 2 and 4, the fixed valve mechanism 70 is positioned between the second drive cam 24 and the second swing cam arm 40R. The fixed valve mechanism 70 interlocks the swing motion of the second swing cam arm 40R with the rotary motion of the second drive cam 24. It includes a great lift arm (input arm) 72, which is driven by the second drive cam 24, and an arm coupling mechanism 78, which couples the great lift arm 72 to the second swing cam arm 40R.

The great lift arm 72 is aligned with the second swing cam arm 40R, is mounted on the control shaft 32, and can rotate independently of the second swing cam arm 40R. An input roller 74, which comes into contact with the circumferential surface of the second drive cam 24, is supported by the great lift arm 72 in a rotatable manner. A lost motion spring (not shown) is hooked onto the great lift arm 72. The force exerted by the lost motion spring presses the input roller 74 against the circumferential surface of the second drive cam 24.

The great lift arm 72 is provided with a pin 80 that can be inserted into and extracted from the second swing cam arm 40R. The great lift arm 72 is also provided with a hydraulic chamber 88, which has an opening that is positioned toward the second swing cam arm 40R. The pin 80 is fit into the hydraulic chamber 88. An oil path 90, which allows hydraulic oil to flow, is connected to the hydraulic chamber 88. When the hydraulic oil is supplied to the inside of the hydraulic chamber 88 from the oil path 90, the resulting hydraulic pressure pushes the pin 80 from the hydraulic chamber 88 to the second swing cam arm 40R.

The second swing cam arm 40R is formed with a pin hole 86 opening toward the great lift arm 72. The pin 80 and pin hole 86 are positioned on the same arc that is formed around the control shaft 32. Therefore, when the second swing cam arm 40R is positioned at a predetermined rotation position with respect to the great lift arm 72, the position of the pin hole 86 coincides with that of the pin 80. A return spring 84 and a piston 82 are placed in the pin hole 86 with the return spring 84 positioned at the innermost end. When the position of the pin hole 86 coincides with that of the pin 80, the pin 80 comes into contact with the piston 82. If, in this instance, the force exerted by the return spring 84 to press the piston 82 is greater than the force exerted by the hydraulic pressure in the hydraulic chamber 88 to press the pin 80, the pin 80 moves into the pin hole 86 in such a manner as to push the piston 82 inward within the pin hole 86. When the pin 80 is inserted into the pin hole 86, the swing cam arm 40R and great lift arm 72 are coupled via the pin 80. In other words, the pin 80, hydraulic chamber 88, oil path 90, pin hole 86, return spring 84, and piston 82 constitute the arm coupling mechanism 78.

[Basic Operation of the Variable Valve-operating Device According to the Present Embodiment]

The basic operation of the variable valve-operating device, which is configured as described above, will now be described with reference to FIGS. 5A, 5B, 6A, and 6B.

(1) Valve Lift Operation of the Variable Valve Mechanism

Figures 5A, 5B:
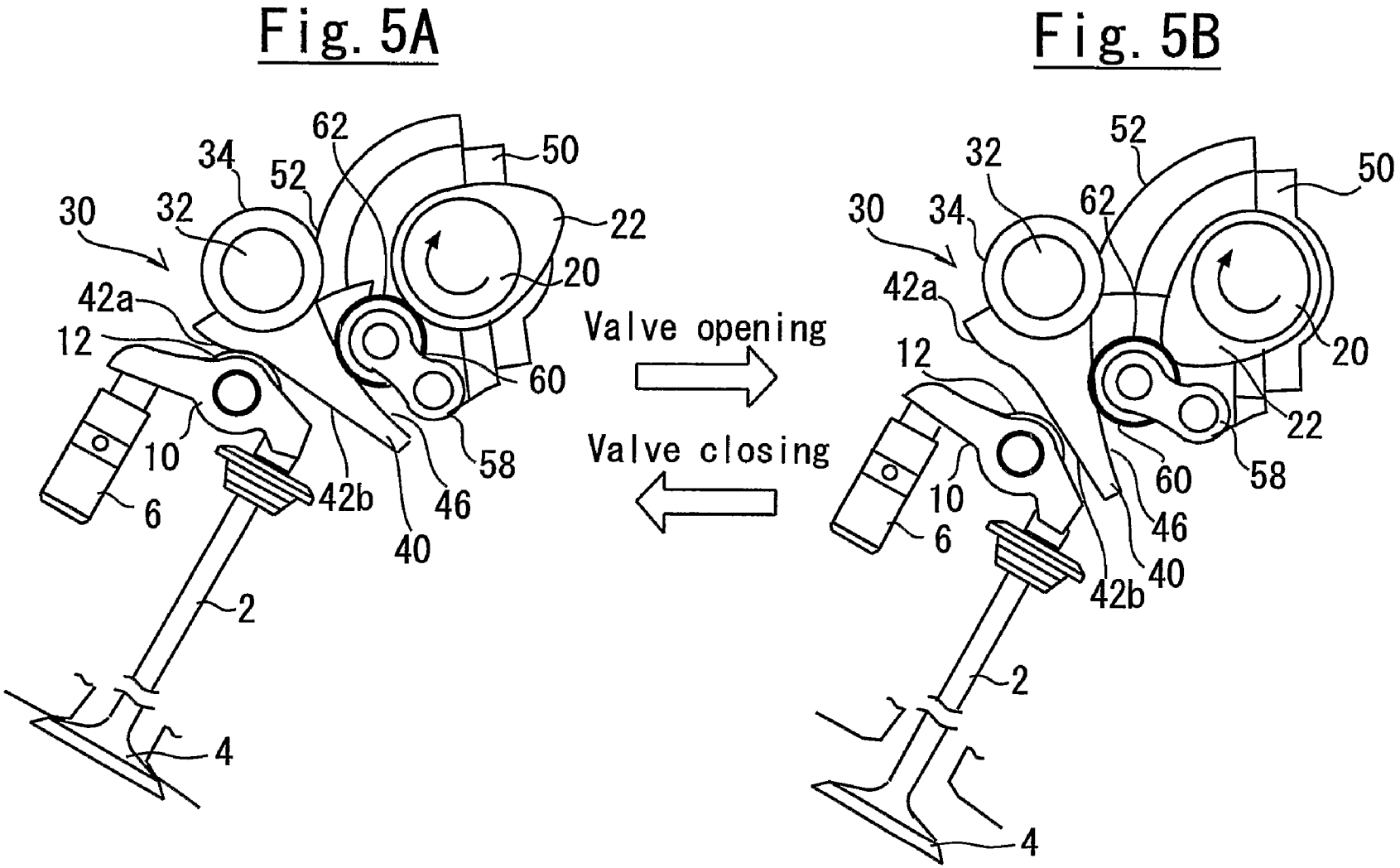
FIG. 5A illustrates a lift operation that the variable valve-operating device shown in FIG. 1 performs to close a valve.
FIG. 5B illustrates a lift operation that the variable valve-operating device shown in FIG. 1 performs to open a valve.

First of all, the operation that the variable valve mechanism 30 performs to lift the valve 4 will be described with reference to FIGS. 5A and 5B. FIG. 5A shows a state of the variable valve mechanism 30 in which the valve 4 is closed during a lift operation. FIG. 5B shows a state of the variable valve mechanism 30 in which the valve 4 is fully open during a lift operation.

In the variable valve mechanism 30, the rotary motion of the first drive cam 22 is first input to the first roller 60, which comes into contact with the first drive cam 22. The first roller 60 and the second rollers 62 are supported by the intermediate arm 58. Therefore, they swing around the connection pin 56, which serves as the fulcrum of the intermediate arm 58. The resulting swing motion is then input to the slide surface 46 of the swing cam arm 40, which comes into contact with the second rollers 62. The slide surface 46 is constantly pressed against the second rollers 62 by the force exerted by the lost motion spring 36. Therefore, the swing cam arm 40 swings around the control shaft 32 in coordination with the rotation of the first drive cam 22, which is transmitted via the second rollers 62.

More specifically, when the camshaft 20 rotates in the state shown in FIG. 5A, the position at which the first roller 60 contacts the first drive cam 22 approaches the apex of the first drive cam 22 as indicated in FIG. 5B. The first roller 60 is then relatively pushed downward by the first drive cam 22, and the slide surface 46 of the swing cam arm 40 is pushed downward by the second rollers 62, which are integral with the first roller 60. This causes the swing cam arm 40 to rotate clockwise around the control shaft 32 (see FIGS. 5A and 5B).

When the swing cam arm 40 turns so that the position at which the rocker roller 12 contacts the swing cam surface 42 moves from the non-operating surface 42*a* to the operating surface 42*b*, the rocker arm 10 is pushed downward in accordance with the distance between the position of the rocker roller 12 on the operating surface 42*b* and the center of the control shaft 32. The rocker arm 10 then swings clockwise around a point of support provided by the hydraulic lash adjuster 6. This causes the rocker arm 10 to lower and open the valve 4. When the position at which the first roller 60 contacts the first drive cam 22 reaches the apex of the first drive cam 22 as indicated in FIG. 5B, the amount of turning the swing cam arm 40 is maximized to maximize the lift amount of the valve 4.

When the camshaft 20 further rotates until the position at which the first roller 60 contacts the first drive cam 22 passes the apex of the first drive cam 22, the swing cam arm 40 turns counterclockwise around the control shaft 32 due to the force exerted by the lost motion spring and valve spring. When the swing cam arm 40 turns counterclockwise, the position at which the rocker roller 12 contacts the swing cam surface 42 moves toward the non-operating surface 42*a*. This decreases the lift amount of the valve 4. When the position at which the rocker roller 12 contacts the swing cam surface 42 later switches from the operating surface 42*b* to the non-operating surface 42*a* as indicated in FIG. 5A, the lift amount of the valve 4 decreases to zero, that is, the valve 4 closes.

(2) Lift Amount Change Operation of the Variable Valve Mechanism

Figures 6A, 6B:
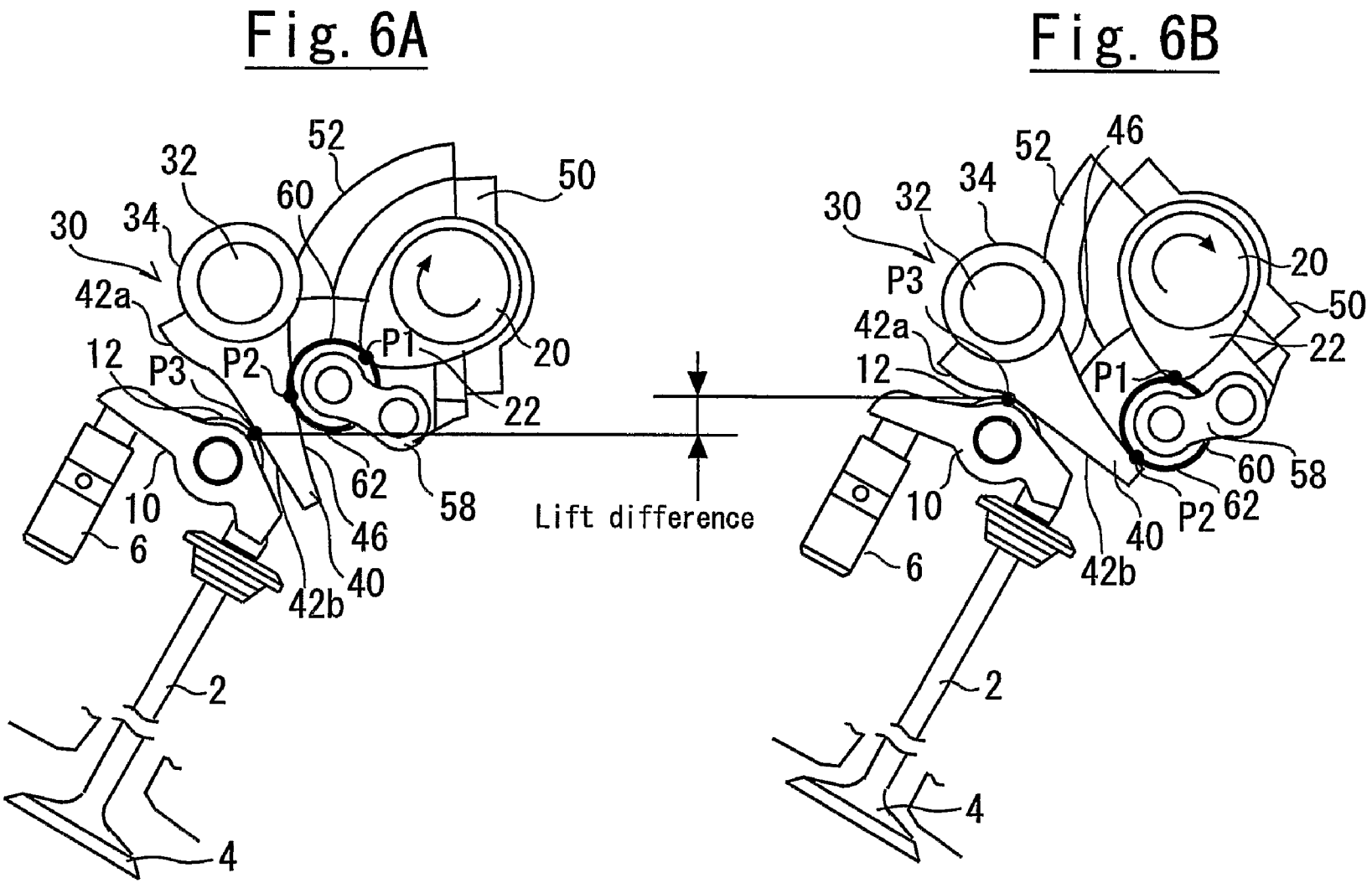
FIG. 6A illustrates a lift amount change operation that the variable valve-operating device shown in FIG. 1 performs to give a great lift.
FIG. 6B illustrates a lift amount change operation that the variable valve-operating device shown in FIG. 1 performs to give a small lift.

The lift amount change operation performed by the variable valve mechanism 30 will now be described with reference to FIGS. 6A and 6B. FIG. 6A shows a maximum lift state of the variable valve mechanism 30 in which the variable valve mechanism 30 operates to give a great lift to the valve 4. FIG. 6B shows a maximum lift state of the variable valve mechanism 30 in which the variable valve mechanism 30 operates to give a small lift to the valve 4.

When the lift amount is to be changed from the lift amount shown in FIG. 6A to the lift amount shown in FIG. 6B, the control shaft 32 is rotated in the same direction as the camshaft 20 in a state shown in FIG. 6A (rotated clockwise). The rotation of the control shaft 32 is transmitted to the control arm 50 via the small-diameter gear 34 and large-diameter gear 52 to rotate the control arm 50 to the rotation position indicated in FIG. 6B. When the control arm 50 rotates, the second rollers 62, which are coupled to the control arm 50 via the intermediate arm 58, move along the slide surface 46 and away from the control shaft 32. At the same time, the first roller 60, which is integral with the second rollers 62, moves along the first drive cam 22 and upstream in the rotation direction of the first drive cam 22.

When the second rollers 62 move away from the control shaft 32, the distance between the swing center of the swing cam arm 40 and the contact position P2 at which the second rollers 62 contact the slide surface 46 increases, thereby decreasing the swing angle of the swing cam arm 40. The reason is that the swing angle of the swing cam arm 40 is in inverse proportion to the distance between the swing center and the contact position P2, which is a driving force input point. When the swing angle of the swing cam arm 40 decreases, the final contact position P3 that the rocker roller 12 can reach moves over the operating surface 42*b* and toward the non-operating surface 42*a*, thereby reducing the lift amount of the valve 4. Further, the crank angle during which the rocker roller 12 is positioned on the operating surface 42*b* is the operating angle of the valve 4. However, when the final contact position P3 moves toward the non-operating surface 42*a*, the operating angle of the valve 4 decreases. Furthermore, since the first roller 60 moves along the first drive cam 22 and upstream in the rotation direction of the first drive cam 22, the contact position P1 of the first roller 60 that prevails when the camshaft 20 is at the same rotation position moves toward the advance side of the first drive cam 22. This advances the swing timing of the swing cam arm 40 in relation to the phase of the first drive cam 22. As a result, the valve timing (maximum lift timing) advances.

When, on the other hand, the lift amount is to be changed from the lift amount shown in FIG. 6B to the lift amount shown in FIG. 6A, the control shaft 32 is rotated in a direction opposite the rotation direction of the camshaft 20 (rotated counterclockwise) in a state shown in FIG. 6B to rotate the control arm 50 to the rotation position shown in FIG. 6A. This moves the second rollers 62 toward the control shaft 32, reduces the distance between the swing center of the swing cam arm 40 and the contact position P2 at which the second rollers 62 contact the slide surface 46, and increases the swing angle of the swing cam arm 40. When the swing angle of the swing cam arm 40 increases, the final contact position P3 that the rocker roller 12 can reach moves toward the leading end of the operating surface 42, thereby increasing the lift amount and operating angle of the valve 4. In this instance, the contact position P1 of the first roller 60 that prevails when the camshaft 20 is at the same rotation position moves toward the retard side of the first drive cam 22. This retards the swing timing of the swing cam arm 40 in relation to the rotation of the first drive cam 22. As a result, the valve timing retards.

[Interlock Switching Operation of the Variable Valve-operating Device According to the Present Embodiment]

When the arm coupling mechanism 78 in the variable valve-operating device according to the present embodiment couples the great lift arm 72 to the second swing cam arm 40R, the fixed valve mechanism 70 can be selected instead of the variable valve mechanism 30R as the mechanism with which the lift motion of the second valve 4R is to be interlocked. When, on the contrary, the arm coupling mechanism 78 uncouples the great lift arm 72 from the second swing cam arm 40R, the variable valve mechanism 30R can be selected instead of the fixed valve mechanism 70 as the mechanism with which the lift motion of the second valve 4R is to be interlocked. The interlock switching operation of the variable valve-operating device according to the present embodiment will now be described in detail with reference to FIGS. 7A to 15.

(1) Coupling the Great Lift Arm to the Second Swing Cam Arm

As described earlier, the positions of the pin 80 and pin hole 86 coincide with each other when the swing cam arm 40R is positioned at a predefined rotation position in relation to the great lift arm 72. When the positions of the pin 80 and pin hole 86 coincide with each other, the pin 80 is inserted into the pin hole 86 so that the great lift arm 72 is coupled to the second swing cam arm 40R. To avoid an erroneous operation of the arm coupling mechanism 78, therefore, it is necessary to set the swing angle of the second swing cam arm 40R so that the position of the pin 80 coincides with that of the pin hole 86 only when the great lift arm 72 is coupled to the second swing cam arm 40R.

Figure 7A:
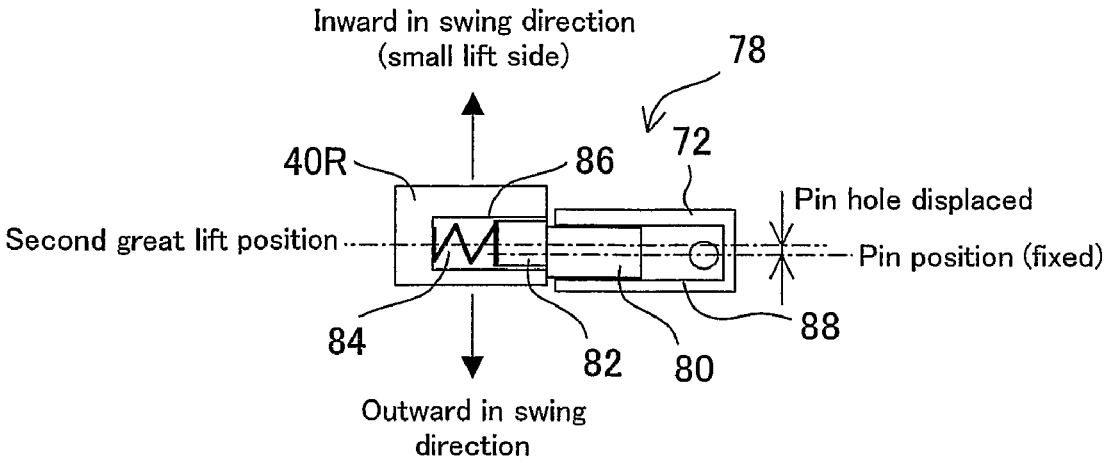
FIG. 7A illustrates an operation that is performed to couple a great lift arm to a second swing cam arm.
Figure 7B:
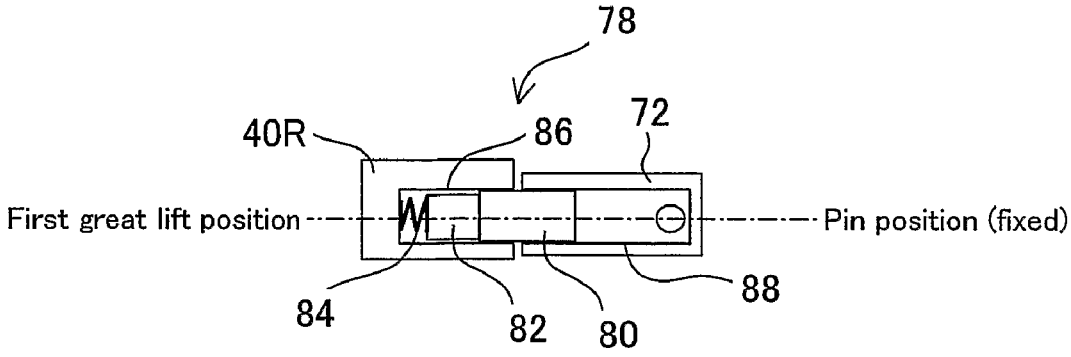
FIG. 7B illustrates an operation that is performed to couple the great lift arm to the second swing cam arm.

FIGS. 7A and 7B illustrate an operation that is performed to couple the great lift arm 72 to the second swing cam arm 40R. When the great lift arm 72 is not coupled to the second swing cam arm 40R, the swing angle of the second swing cam arm 40R is set so that the positional relationship between the pin 80 and pin hole 86 is as indicated in FIG. 7A. When, on the other hand, the great lift arm 72 is coupled to the second swing cam arm 40R, the swing angle of the second swing cam arm 40R is set so that the positional relationship between the pin 80 and pin hole 86 is as indicated in FIG. 7B.

The "pin position" shown in FIGS. 7A and 7B represents the outermost position on the valve closing side that prevails when the second drive cam 24 drives the great lift arm 72 to reciprocate the pin 80 along the arc. When the pin 80 is at the "pin position," the input roller 74 is in contact with the cam base circle of the second drive cam 24. While the input roller 74 is in contact with the cam base circle, the great lift arm 72 is stationary. While the great lift arm 72 is stationary, the pin 80 is at the "pin position." Since the swing angle of the great lift arm 72 is constantly fixed without regard to the rotation position of the control shaft 32, the "pin position" remains fixed without regard to the rotation position of the control shaft 32.

On the other hand, the swing angle of the second swing cam arm 40R varies with the rotation position of the control shaft 32. As described earlier, when the control shaft 32 rotates so as to increase the lift amount and operating angle of the second valve 4R, the swing angle of the second swing cam arm 40R increases. When the control shaft 32 rotates so as to decrease the lift amount and operating angle of the second valve 4R, the swing angle of the second swing cam arm 40R decreases. The "second great lift position" shown in FIG. 7A represents the outermost position on the valve closing side that prevails when the rotation position of the control shaft 32 is set for the maximum lift angle within the normal use range with the swing angle of the second swing cam arm 40R set to the maximum angle within the normal use range to reciprocate the pin hole 86 along the arc. When the pin hole 86 is at the "second great lift position," the first roller 60 is in contact with the cam base circle of the first drive cam 22 and the second swing cam arm 40R is at a zero lift position at which the second valve 4R will not be lifted. While the first roller 60 is in contact with the cam base circle of the first drive cam 22, the second swing cam arm 40R is stationary at the zero lift position.

As indicated in FIG. 7A, the "second great lift position" is between the "pin position" and the inside in the swing direction of the second swing cam arm 40R. The "second great lift position" corresponds to the maximum lift of the second valve 4R within the normal use range, and the swing angle of the second swing cam arm 40R decreases when the lift amount of the second valve 4R is adjusted for a smaller lift. Therefore, when the rotation position of the control shaft 32 is within the normal use range, the position of the pin 80 does not coincide with that of the pin hole 86. In other words, the great lift arm 72 will not be erroneously coupled to the second swing cam arm 40R.

When the great lift arm 72 and the second swing cam arm 40R are to be coupled, the control shaft 32 is rotated beyond the normal use range and toward the great lift side in order to move the position of the second rollers 62 on the slide surface 46 toward the great lift side. This increases the swing angle of the swing cam arm 40R, and ensures that the outermost position on the valve closing side that prevails when the pin hole 86 moves along the arc moves outward beyond the "second great lift position." The "first great lift position" shown in FIG. 7B represents the position of the pin hole 86 that prevails when the swing angle of the second swing cam arm 40R is increased beyond the normal use range as described above, and is adjusted for the "pin position" on the side toward the pin 80. Consequently, when the swing angle of the second swing cam arm 40R is changed to place the pin hole 86 at the "first great lift position," the position of the pin 80 coincides with that of the pin hole 86, thereby making it possible to couple the great lift arm 72 to the second swing cam arm 40R.

Figure 8:
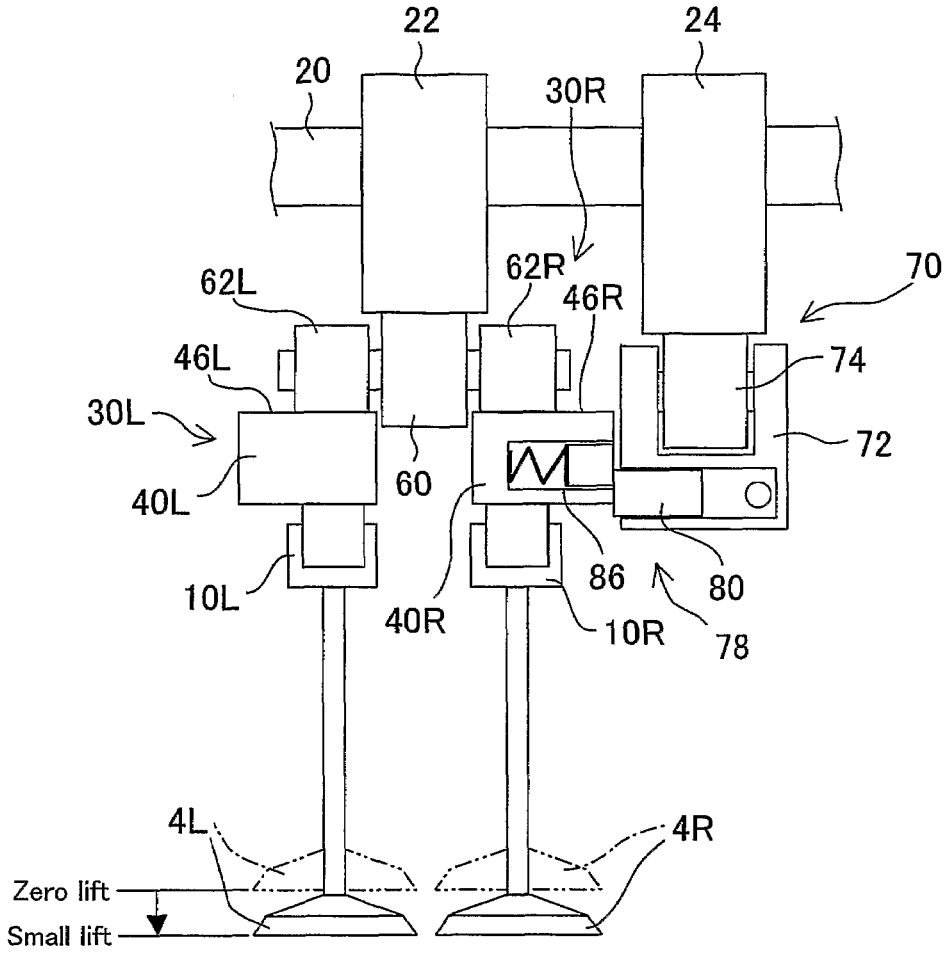
FIG. 8 is a schematic diagram illustrating a lift operation that the variable valve-operating device performs while the great lift arm is uncoupled from the second swing cam arm.

(2) Dual Valve Variable Control Exercised with the Great Lift Arm Uncoupled from the Second Swing Cam Arm FIG. 8 is a schematic diagram illustrating a lift operation that is performed while the great lift arm 72 and the second swing cam arm 40R are uncoupled. As indicated in FIG. 8, while the pin 80 is not engaged in the pin hole 86 and the great lift arm 72 is not coupled to the second swing cam arm 40R, the rotary motion of the camshaft 20 is transmitted from the first drive cam 22 to the slide surface 46L of the first swing cam arm 40L via the first roller 60 and second roller 62L, and converted to the swing motion of the first swing cam arm 40L. The swing motion of the first swing cam arm 40L is transmitted to the rocker arm 10L and then converted to the lift motion of the first valve 4L.

The rotary motion of the camshaft 20 is also transmitted from the first drive cam 22 to the slide surface 46R of the second swing cam arm 40R via the first roller 60 and second roller 62R, and converted to the swing motion of the second swing cam arm 40R. The swing motion of the second swing cam arm 40R is transmitted to the rocker arm 10R and then converted to the lift motion of the second valve 4R.

When the control shaft 32 (not shown in FIG. 8) rotates, the first roller 60 and the second rollers 62L, 62R move along the circumferential surface of the first drive cam 22 in accordance with the rotation position of the control shaft 32. As a result, the position of the second roller 62L on the slide surface 46L changes. This causes the swing angle and initial swing position of the first swing cam arm 40L to change, thereby changing the lift amount of the first valve 4L. Similarly, the position of the second roller 62R on the slide surface 46R also changes. This causes the swing angle and initial swing position of the second swing cam arm 40R to change, thereby changing the lift amount of the second valve 4R. It means that the first valve 4L and the second valve 4R can change their lift amounts in accordance with the rotation of the control shaft 32. In this instance, the lift amount of the first valve 4L is always equal to the lift amount of the second valve 4R as shown in FIG. 8.

Further, since the first roller 60 changes its position in relation to the camshaft 20, the first swing cam arm 40L and second swing cam arm 40R change their swing timing in relation to the rotation of the camshaft 20. As a result, the first valve 4L and second valve 4R change their valve timing in accordance with the rotation of the control shaft 32. In this instance, the valve timing of the first valve 4L is always the same as that of the second valve 4R.

Figure 9:
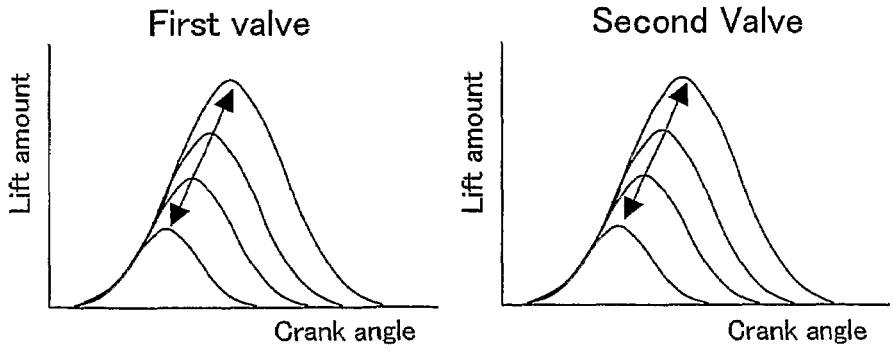
FIG. 9 presents graphs illustrating the relationship between the valve timing and lift amount of a right- or left-hand valve that prevails while the great lift arm is uncoupled from the second swing cam arm.

FIG. 9 presents graphs illustrating the relationship between the lift amount and valve timing of the valves 4L, 4R that the variable valve-operating device according to the present embodiment provides while the great lift arm 72 is uncoupled from the second swing cam arm 40R. The left-hand graph in FIG. 9 illustrates the relationship between the lift amount and valve timing of the first valve 4L, whereas the right-hand graph illustrates the relationship between the lift amount and valve timing of the second valve 4R. While the great lift arm 72 is uncoupled from the second swing cam arm 40R, variable control can be exercised over the lift amount and valve timing of both the left- and right-hand valves 4L, 4R as indicated in FIG. 9. In other words, dual valve variable control can be exercised. In the dual valve variable control mode, the valve timing can be retarded in accordance with an increase in the lift amounts of the valves 4L, 4R, and advanced in accordance with a decrease in the lift amounts of the valves 4L, 4R.

Figure 10:
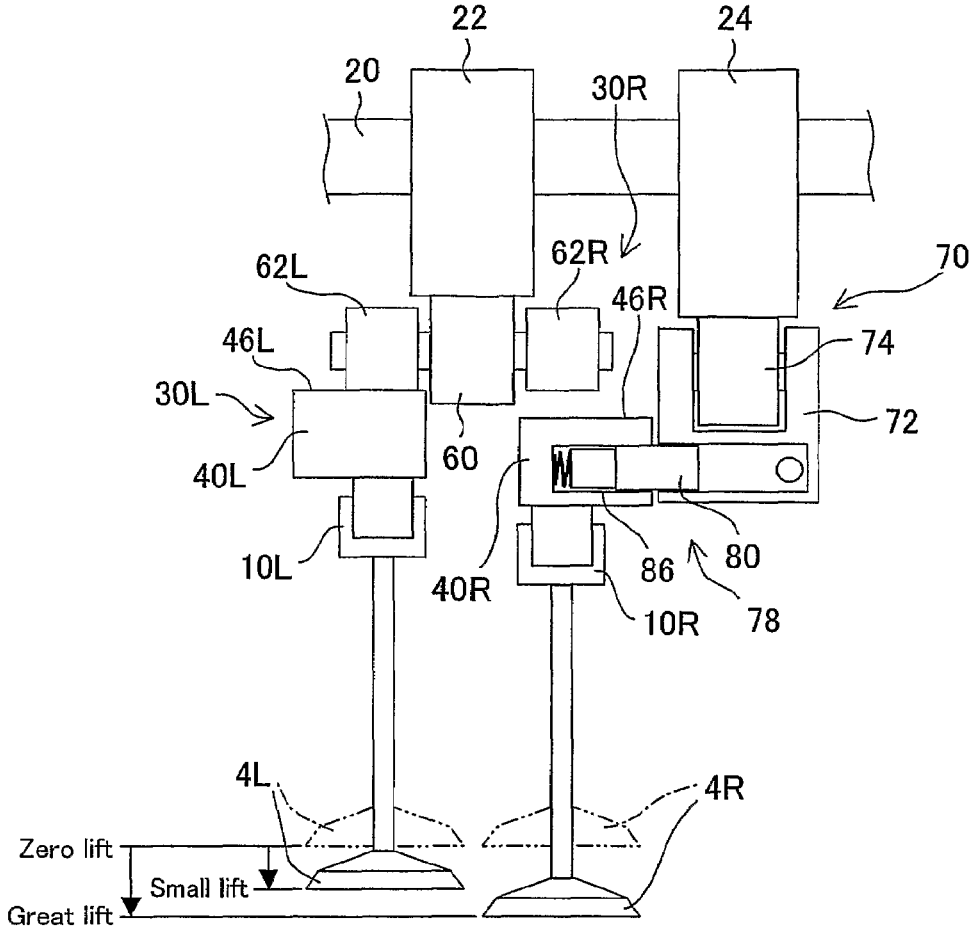
FIG. 10 is a schematic diagram illustrating a lift operation that the variable valve-operating device performs while the great lift arm is coupled to the second swing cam arm.

(3) Single Valve Variable Control Exercised with the Great Lift Arm Coupled to the Second Swing Cam Arm FIG. 10 is a schematic diagram illustrating a lift operation that is performed while the great lift arm 72 and the second swing cam arm 40R are coupled. As indicated in FIG. 10, while the pin 80 is engaged in the pin hole 86 and the great lift arm 72 is coupled to the second swing cam arm 40R, the rotary motion of the camshaft 20 is transmitted from the second drive cam 24 to the second swing cam arm 40R via the great lift arm 72. The swing motion of the second swing cam arm 40R is transmitted to the rocker arm 10R and then converted to the lift motion of the second valve 4R.

As described earlier, the great lift arm 72 and the second swing cam arm 40R are coupled when the control shaft 32 rotates to move the position of the second roller 62R on the slide surface 46R beyond the normal use range and toward the great lift side. As indicated in FIGS. 6A and 6B, the initial swing position of the second swing cam arm 40R (the swing position prevailing when the first roller 60 is in contact with the cam base circle of the first drive cam 22) moves toward the great lift side. Therefore, the initial swing position of the second swing cam arm 40R that prevails when the great lift arm 72 is coupled to the swing cam arm 40R is beyond the maximum initial swing position within the normal use range. The distance between the circumferential surface of the first drive cam 22 and the slide surface 46R of the second swing cam arm 40R becomes large as the initial swing position of the second swing cam arm 40R moves toward the great lift side. Therefore, when the great lift arm 72 is coupled to the swing cam arm 40R, the slide surface 46R does not interfere with the second roller 62R within the normal movement range of the second roller 62R when the second swing cam arm 40R swings. In other words, the operating characteristic of the second valve 4R is mechanically determined by the shapes of the second drive cam 24, great lift arm 72, and second swing cam arm 40R and by the positional relationship among them. A constant operating characteristic is always maintained without regard to the rotation position of the control shaft.

On the other hand, the rotary motion of the camshaft 20 is transmitted from the first drive cam 22 to the first swing cam arm 40L via the first roller 60 and second roller 62L. Therefore, when the control shaft 32 rotates to change the positions of the first roller 60 and second roller 62L in relation to the camshaft 20, the first swing cam arm 40L changes its swing angle, initial swing position, and swing timing. Since the swing motion of the first swing cam arm 40L is transmitted to the rocker arm 10L and then converted to the lift motion of the first valve 4L, the operating characteristic of the first valve changes in accordance with the rotation position of the control shaft 32 as is the case where the great lift arm 72 is uncoupled from the swing cam arm 40R.

Figure 11:
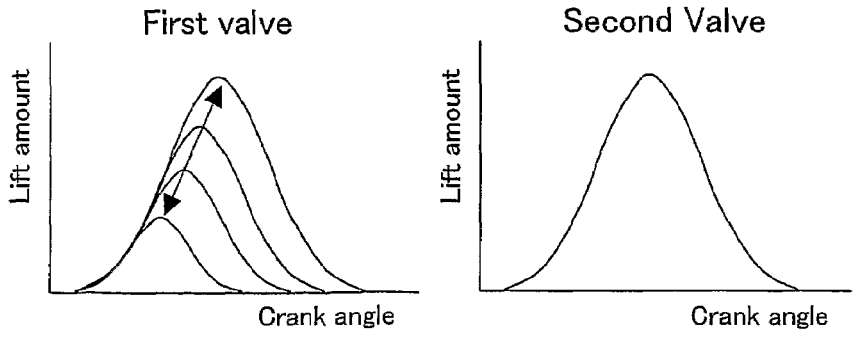
FIG. 11 presents graphs illustrating the relationship between the valve timing and lift amount of the right- or left-hand valve that prevails while the great lift arm is coupled to the second swing cam arm.

FIG. 11 presents graphs illustrating the relationship between the lift amount and valve timing of the valves 4L, 4R that the variable valve-operating device according to the present embodiment provides while the great lift arm 72 is coupled to the swing cam arm 40R. The left-hand graph in FIG. 11 illustrates the relationship between the lift amount and valve timing of the first valve 4L, whereas the right-hand graph illustrates the relationship between the lift amount and valve timing of the second valve 4R. While the great lift arm 72 is coupled to the swing cam arm 40R, control is exercised so that the second valve 4R is provided with a fixed lift amount and valve timing, and variable control can be exercised over the lift amount and valve timing of the first valve 4L, as indicated in FIG. 11. In other words, single valve variable control can be exercised when the great lift arm 72 is coupled to the swing cam arm 40R. In the single valve variable control mode, the lift amount of the second valve 4R is fixed so that it is not smaller than the maximum lift amount setting for causing the first drive cam 22 to swing the second swing cam arm 40R. Therefore, when the lift amount of the first valve 4L is changed to control the lift amount difference between the two valves 4L, 4R, the swirl control can be exercised over an air-fuel mixture flow within a cylinder.

(4) Hydraulic Control for Switching between Dual Valve Variable Control and Single Valve Variable Control The control exercised over the hydraulic pressure to be supplied to the pin 80 will now be described. Control mode switching from dual valve variable control to single valve variable control or from single valve variable control to dual valve variable control is achieved by controlling the hydraulic pressure supply to the pin 80 to couple the great lift arm 72 to the second swing cam arm 40R or uncouple the great lift arm 72 from the second swing cam arm 40R.

Figure 12:
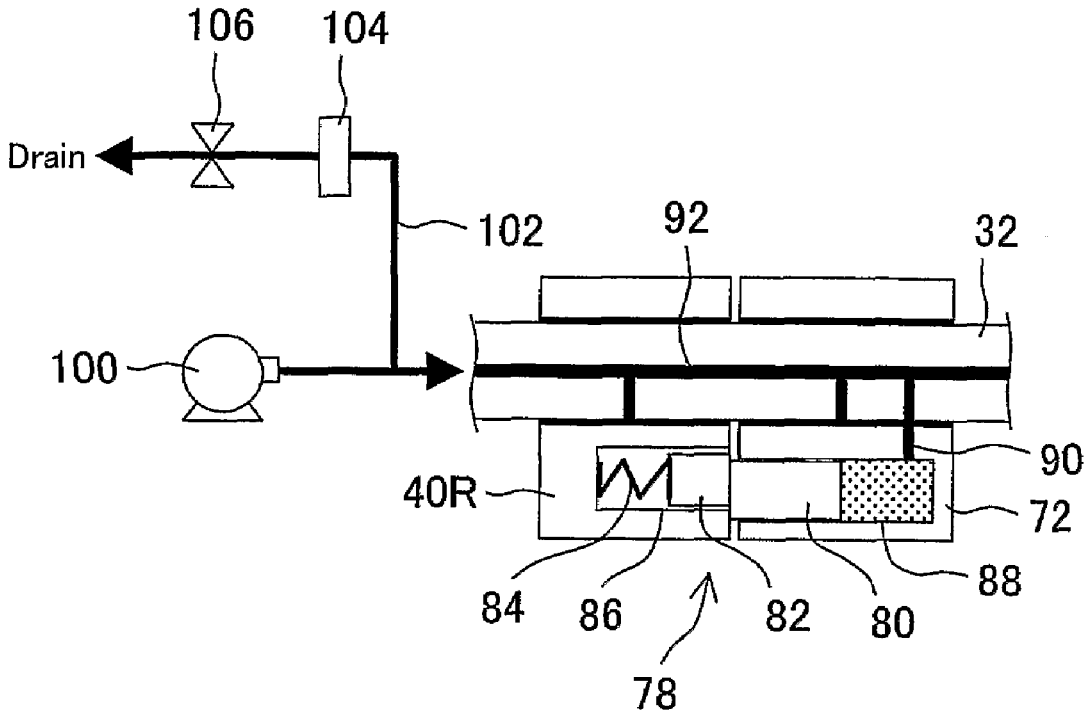
FIG. 12 illustrates the configuration of a hydraulic system for operating a pin according to the first embodiment of the present invention.

FIG. 12 illustrates the configuration of a hydraulic system for operating the pin 80. As shown in FIG. 12, an oil path 92 is formed in the control shaft 32, and connected to a sliding gap between the control shaft 32 and great lift arm 72 and to a sliding gap between the control shaft 32 and second swing cam arm 40R. A pump 100 is installed upstream of the oil path 92. Lubricating oil, which is pressurized by the pump 100, is supplied to the sliding gaps between the control shaft 32 and arms 72, 40R via the oil path 92. In the present embodiment, another oil path 90 is used to connect the lubricating oil path 92 to the hydraulic chamber 88 in the great lift arm 72. This oil path 90 supplies part of the lubricating oil flow in the oil path 92 to the hydraulic chamber 88. The lubricating oil supplied in this manner then functions as the hydraulic oil for applying hydraulic pressure to the pin 80. When the lubricating oil path 92 doubles as the oil path for the hydraulic oil, the oil path configuration for the entire device can be simplified.

Figure 13:
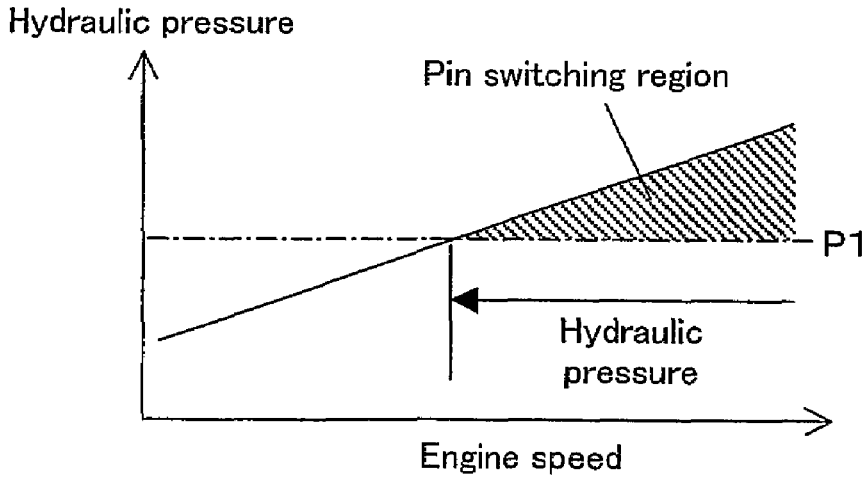
FIG. 13 illustrates the relationship between the engine speed and the hydraulic pressure in the hydraulic system shown in FIG. 12.

The pump 100 is driven by the internal combustion engine; therefore, the hydraulic pressure is influenced by the engine speed as indicated in FIG. 13. In a situation where the hydraulic pressure is not raised due to a low engine speed, the pin 80 cannot be inserted into the pin hole 86 against the force that the return spring 84 exerts to push the piston 82 even when the position of the pin 80 coincides with that of the pin hole 36. Therefore, the controller for controlling the variable valve-operating device inhibits the great lift arm 72 from being coupled to the second swing cam arm 40R before the hydraulic pressure reaches a predetermined pressure P1 due to an increase in the engine speed. The predetermined pressure P1 should be equivalent to a hydraulic pressure for promptly inserting the pin 80 into the pin hole 86. For example, the predetermined pressure P1 can be obtained by multiplying the maximum spring force of the return spring 84 by the pin pressure reception area.

When, on the other hand, the great lift arm 72 is to be uncoupled from the second swing cam arm 40R, the pin 80 is extracted from the pin hole 86. In this instance, it is necessary to decrease the hydraulic pressure in the hydraulic chamber 88 so that the piston 82 pushes the pin 80 back into the hydraulic chamber 88. However, since the pump 100 is driven by the internal combustion engine, it is difficult to decrease the hydraulic pressure by controlling the rotation speed of the pump 100. In the present embodiment, therefore, a discharge path 102 is provided to expel the lubricating oil from the oil path 92. When the great lift arm 72 is to be uncoupled from the second swing cam arm 40R, the lubricating oil is discharged via the discharge path 102 to lower the hydraulic pressure of the lubricating oil flow in the oil path 92, thereby reducing the force applied by the hydraulic pressure to push the pin 80. The discharge path 102 is provided with a solenoid valve (discharge valve) 104, which opens/closes the discharge path 102. An orifice 106 is positioned downstream of the solenoid valve 104 in the discharge path 102. The orifice 106 restricts the rate of lubricating oil flow from the discharge path 102 so that at least the minimum required amount of lubricating oil is supplied to the arms 72, 40R.

Figure 14:
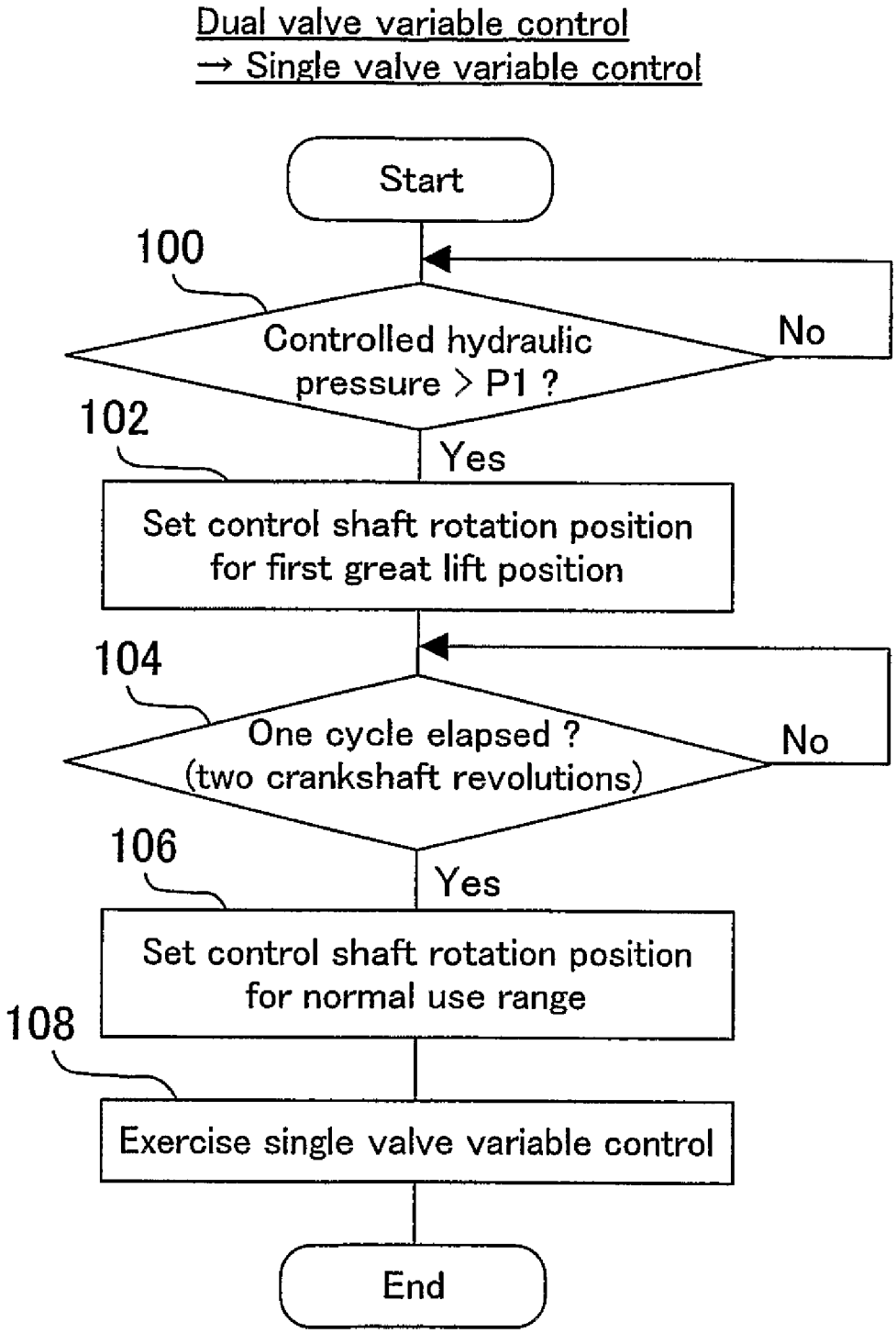
FIG. 14 is a flowchart illustrating a hydraulic control routine that is executed in the first embodiment of the present invention to switch from dual valve variable control to single valve variable control.
Figure 15:
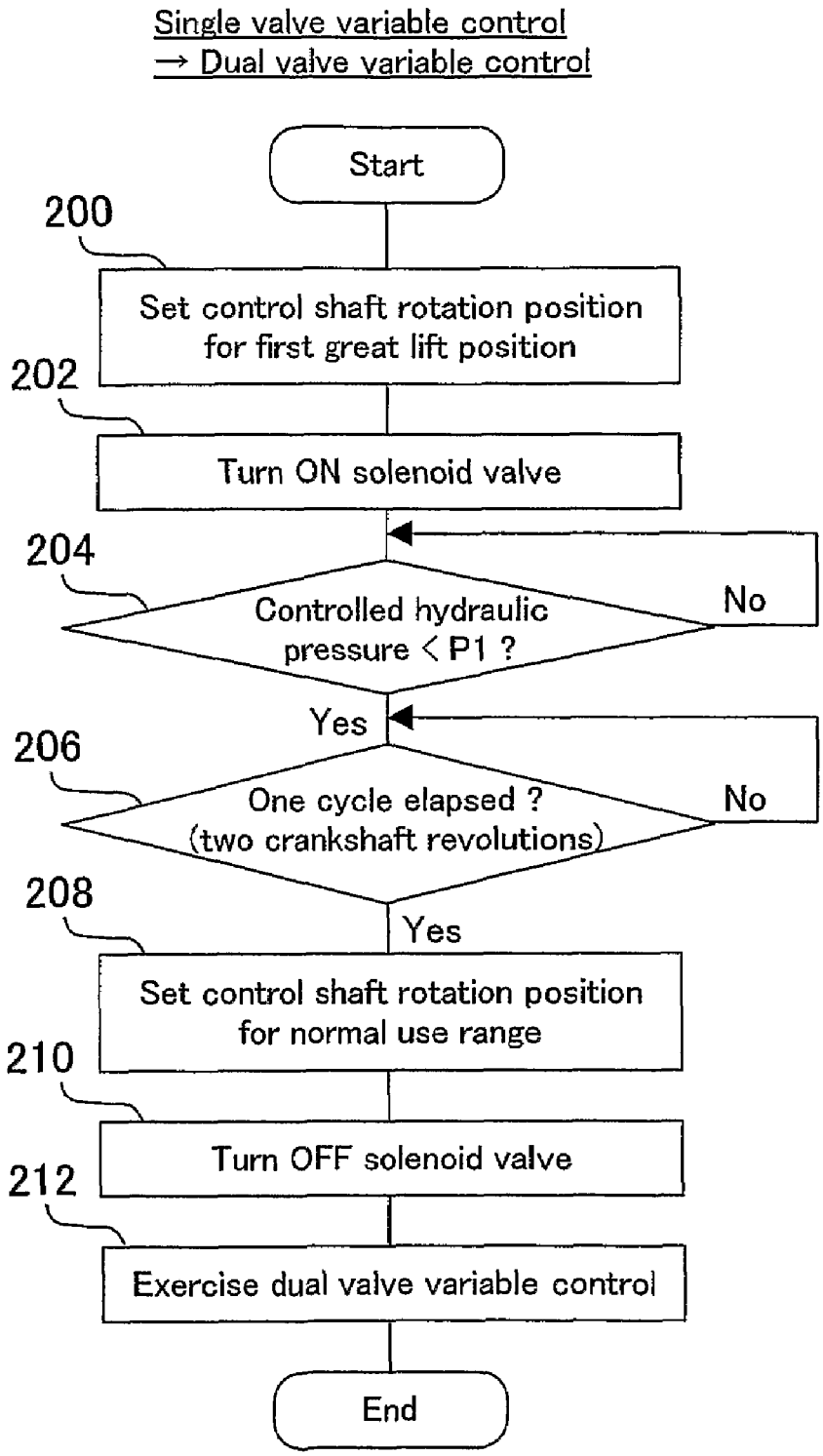
FIG. 15 is a flowchart illustrating a hydraulic control routine that is executed in the first embodiment of the present invention to switch from single valve variable control to dual valve variable control.

FIGS. 14 and 15 are flowcharts illustrating specific details of the hydraulic control that is exercised by the variable valve-operating device according to the present embodiment. The flowchart in FIG. 14 illustrates a hydraulic control routine that is executed to switch from dual valve variable control to single valve variable control. The flowchart in FIG. 15 illustrates a hydraulic control routine that is executed to switch from single valve variable control to dual valve variable control.

If an instruction for single valve variable control is issued to the controller for the variable valve-operating device while dual valve variable control is exercised, the controller for the variable valve-operating device executes the routine shown in FIG. 14 to exercise hydraulic control. First of all, step 100 is performed to judge whether the predetermined pressure P1 is reached by the hydraulic pressure of the lubricating oil flow in the oil path 92 (controlled hydraulic pressure). The hydraulic pressure is measured by a hydraulic pressure sensor in the internal combustion engine. No subsequent step is performed until the hydraulic pressure reaches the predetermined pressure P1. A standby state persists until the judgment result obtained in step 100 indicates that the predetermined pressure P1 is reached.

When the hydraulic pressure exceeds the predetermined pressure P1, the control shaft 32 rotates to move the position of the second roller 62R on the slide surface 46R toward the great lift side, and change the swing angle of the second swing cam arm 40R to place the pin hole 86 in the "first great lift position" (step 102). Next, step 104 is performed to wait until one cycle elapses (the crankshaft makes two revolutions) while the rotation position of the control shaft 32 is maintained at the position set in step 102. When the second swing cam arm 40R swings to the above swing angle, the pin hole 86 passes the "first great lift position" without fail before the elapse of one cycle. In such an instance, the position of the pin 80 coincides with that of the pin hole 86 so that the hydraulic pressure in the hydraulic chamber 88 generates a driving force to promptly insert the pin 80 into the pin hole 86. This ensures that the great lift arm 72 is completely coupled to the second swing cam arm 40R.

After the elapse of one cycle, the control shaft 32 rotates in a direction opposite to the rotation direction employed in step 102 until the rotation position of the control shaft 32 reverts to the normal use range (step 106). The second roller 62R then completely leaves the slide surface 46R of the second swing cam arm 40R, thereby allowing the second drive cam 24 to drive the second swing cam arm 40R. Consequently, the second valve 4R is set for a fixed lift amount and valve timing. On the other hand, the first swing cam arm 40L is driven by the first drive cam 22 as is the case with the dual valve variable control mode so that variable control can be exercised over the lift amount and valve timing of the first valve 4L by rotating the control shaft 32. Subsequently, the controller exercises single valve variable control over the variable valve-operating device (step 108).

If an instruction for dual valve variable control is issued to the controller for the variable valve-operating device while single valve variable control is exercised, the controller for the variable valve-operating device executes the routine shown in FIG. 15 to exercise hydraulic control. In the first step (step 200), the control shaft 32 rotates beyond the normal use range and toward the great lift side to adjust its rotation position to a position that corresponds to the "first great lift position.".

In the next step (step 202), the solenoid valve 104 turns ON to start to discharge the lubricating oil via the discharge path 102. After the solenoid valve 104 is turned ON, step 204 is performed to judge whether the hydraulic pressure of a lubricating oil flow in the oil path 92 (controlled hydraulic pressure) is lower than the predetermined pressure P1. No subsequent step is performed until the hydraulic pressure drops below the predetermined pressure P1. A standby state persists until the judgment result obtained in step 204 indicates that the hydraulic pressure of the lubricating oil flow in the oil path 92 is lower than the predetermined pressure P1.

When the hydraulic pressure drops below the predetermined pressure P1, step 206 is performed to wait until one cycle elapses (the crankshaft makes two revolutions) while the rotation position of the control shaft 32 is maintained at the position set in step 200. Since the hydraulic pressure is below the predetermined pressure P1, the piston 82 pushes the pin 80 out of the pin hole 86. When one cycle elapses, the pin 80 leaves the pin hole 86. This completely uncouples the great lift arm 72 from the second swing cam arm 40R.

After the elapse of one cycle, the control shaft 32 rotates in a direction opposite to the rotation direction employed in step 200 until the rotation position of the control shaft 32 reverts to the normal use range (step 208). This brings the second roller 62R into contact with the slide surface 46R of the second swing cam arm 40R so that the second swing cam arm 40R is driven by the first drive cam 22 as is the case with the first swing cam arm 40L. In other words, when the control shaft 32 rotates, variable control can be exercised over the lift amount and valve timing of the valves 4L, 4R. When the rotation position of the control shaft 32 reverts to the normal use range, the solenoid valve 102 turns OFF to stop the discharge of lubricating oil from the discharge path 102 (step 210). Subsequently, the controller exercises dual valve variable control over the variable valve-operating device (step 212).

[Advantages of the Variable Valve-operating Device According to the Present Embodiment]

As described above, the variable valve-operating device according to the present embodiment can change the operating characteristic control mode for the second valve 4R from variable control to fixed control simply by coupling the great lift arm 72 to the second swing cam arm 40R, and change the operating characteristic control mode for the second valve 4R from fixed control to variable control simply by uncoupling the great lift arm 72 from the second swing cam arm 40R. This makes it easy to properly switch from the dual valve variable control mode, in which the operating characteristics of the first valve 4L and second valve 4R can be changed in accordance with the rotation position of the control shaft 32, to the single valve variable control mode, in which the operating characteristic of the first valve 4L can be changed in accordance with the rotation position of the control shaft 32 while the operating characteristic of the second valve 4R is fixed. It is also easy to properly switch from the single valve variable control mode to the dual valve variable control mode.

According to the variable valve-operating device according to the present embodiment, the great lift arm 72 can be coupled to the second swing cam arm 40R by using an extremely simple structure that inserts the pin 80 into the pin hole 86. Further, the position of the pin hole 86 does not coincide with that of the pin 80 while the rotation position of the control shaft 32 is within the normal use range. Therefore, the second valve 4R does not erroneously switch to a fixed operation while it is engaged in a variable operation.

Further, the aforementioned "pin position" and "first great lift position" are defined with reference to the zero lift positions of the arms 40R, 72. Therefore, the pin 80 can be inserted into the pin hole 86 while the arms 40R, 72 are stationary. Therefore, the variable valve-operating device according to the present embodiment can properly couple the great lift arm 72 to the second swing cam arm 40R.

When the control mode changes from dual valve variable control to single valve variable control, the control shaft 32 rotates beyond the normal use range and toward the great lift side. Therefore, the lift amount of the second valve 4R temporarily increases above the maximum lift amount for the normal use range. However, the influence of the lift amount difference upon the intake air amount decreases toward the great lift side. Therefore, a lift amount change at the time of a control mode change does not significantly change the intake air amount.

Furthermore, the parts required for exercising single valve variable control in addition to dual valve variable control are limited to the great lift arm 72 and arm coupling mechanism 78, which constitute the fixed valve mechanism 70. Therefore, the variable valve-operating device according to the present embodiment has the advantage that the number of parts can be minimized. Moreover, the great lift arm 72 is positioned just next to the second swing cam arm 40R. When compared to a situation where the fixed valve mechanism 70 is not furnished, the length in axial direction merely increases by the length of the great lift arm 72. Therefore, the variable valve-operating device according to the present embodiment is also advantageous in that an undue increase in the size of the entire device can be avoided.

Second Embodiment

A second embodiment of the present invention will now be described with reference to FIGS. 16 to 19.

The variable valve-operating device according to the second embodiment differs from the variable valve-operating device according to the first embodiment in the hydraulic system configuration for pin operation. The second embodiment is equal to the first embodiment in the basic configuration and operation of the variable valve mechanism and fixed valve mechanism. Such configuration and operation can be depicted by FIGS. 1 to 11. The subsequent description mainly deals with the differences from the first embodiment.

Figure 16:
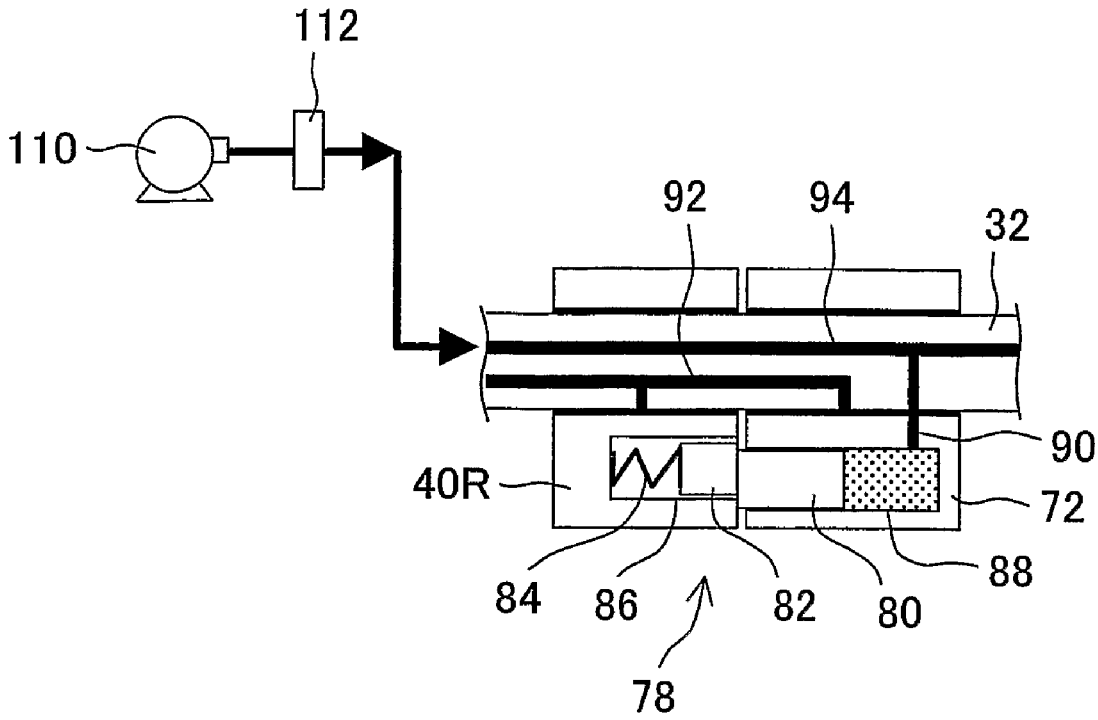
FIG. 16 illustrates the configuration of a hydraulic system for operating a pin according to a second embodiment of the present invention.

FIG. 16 illustrates the configuration of a hydraulic system for operating the pin 80. As shown in FIG. 16, the oil path 92 is formed in the control shaft 32 to connect with a sliding gap between the control shaft 32 and great lift arm 72 and with a sliding gap between the control shaft 32 and second swing cam arm 40R. In the second embodiment, a hydraulic oil path 94 is formed in the control shaft 32 in addition to the lubricating oil path 92. The hydraulic oil path 94 is connected to the hydraulic chamber 88 in the great lift arm 72 via the oil path 90. A pump 110 is installed upstream of the oil path 94. Hydraulic oil pressurized by the pump 110 is supplied to the hydraulic chamber 88 via the oil path 94 to apply hydraulic pressure to the pin 80. The pump 110 may double as the pump for supplying lubricating oil to the oil path 92.

A solenoid valve (discharge valve) 112, which opens/closes the oil path 94, is installed downstream of the pump 110 in the oil path 94. When the solenoid valve 112 opens, hydraulic oil is supplied to the hydraulic chamber 88 via the oil path 94 so that the hydraulic pressure applied to the pin 80 increases. When, on the other hand, the solenoid valve 112 closes, the hydraulic oil supply to the oil path 94 is shut off. The hydraulic oil in the oil path 94 leaks little by little through the sliding gap between the control shaft 32 and great lift arm 72. Therefore, when the hydraulic oil supply is shut off, the hydraulic pressure in the oil path 94 lowers to reduce the hydraulic pressure applied to the pin 80. Consequently, the great lift arm 72 can be coupled to the second swing cam arm 40R by opening the solenoid valve 112, and the great lift arm 72 can be uncoupled from the second swing cam arm 40R by closing the solenoid valve 112. As described above, the solenoid valve 112 opens only when the great lift arm 72 is to be coupled to the second swing cam arm 40R. As a result, the hydraulic oil can be saved by reducing the amount of hydraulic oil leakage from the sliding gap.

Figure 17:
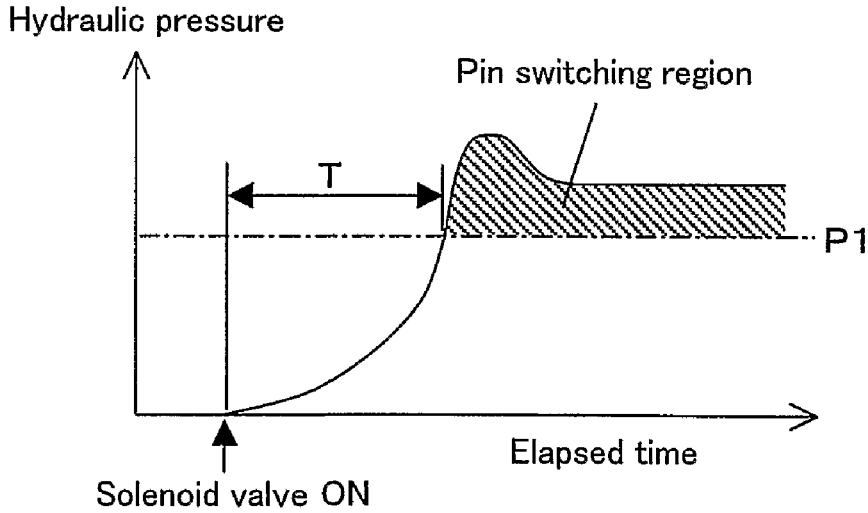
FIG. 17 illustrates the relationship between the engine speed and the hydraulic pressure in the hydraulic system shown in FIG. 16.

Hydraulic pressure is relieved from the hydraulic chamber 88 and oil path 94 when the solenoid valve 112 is closed. Therefore, a certain amount of standby time T is required between the instant at which the solenoid valve 112 is opened again and the instant at which the hydraulic pressure reaches the predetermined pressure P1, as indicated in FIG. 17. The standby time T varies with the temperature because it is influenced by the viscosity of hydraulic oil. If the predetermined pressure P1 is not reached by the hydraulic pressure, the pin 80 cannot be inserted into the pin hole 86 against the force that is exerted by the return spring 84 to push the piston 82 no matter whether the position of the pin 80 coincides with that of the pin hole 36. Therefore, the controller for controlling the variable valve-operating device inhibits the great lift arm 72 from being coupled to the second swing cam arm 40R during the time interval between the instant at which the solenoid valve 112 opens and the instant at which the hydraulic pressure reaches the predetermined pressure P1.

Figure 18:
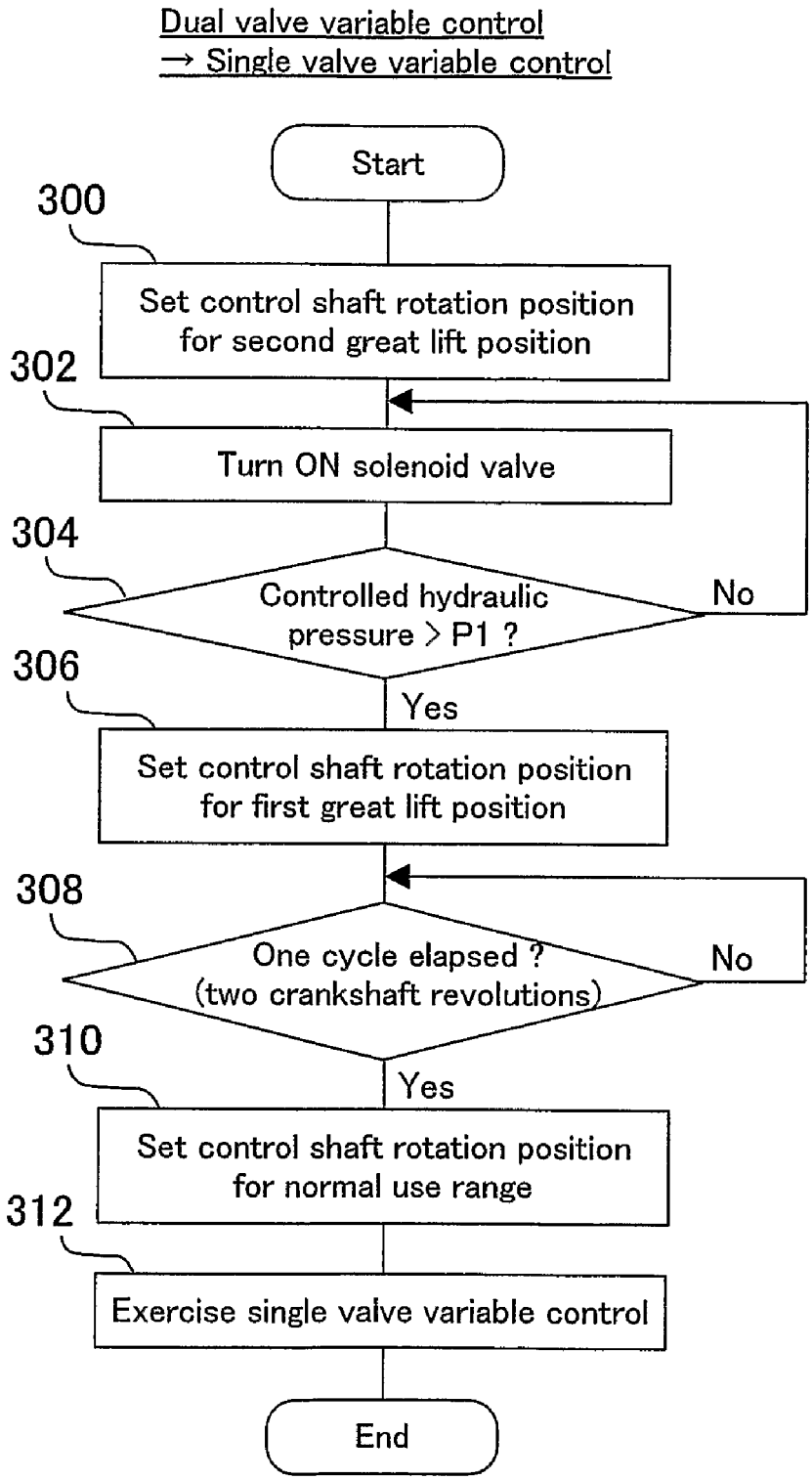
FIG. 18 is a flowchart illustrating a hydraulic control routine that is executed in the second embodiment of the present invention to switch from dual valve variable control to single valve variable control.
Figure 19:
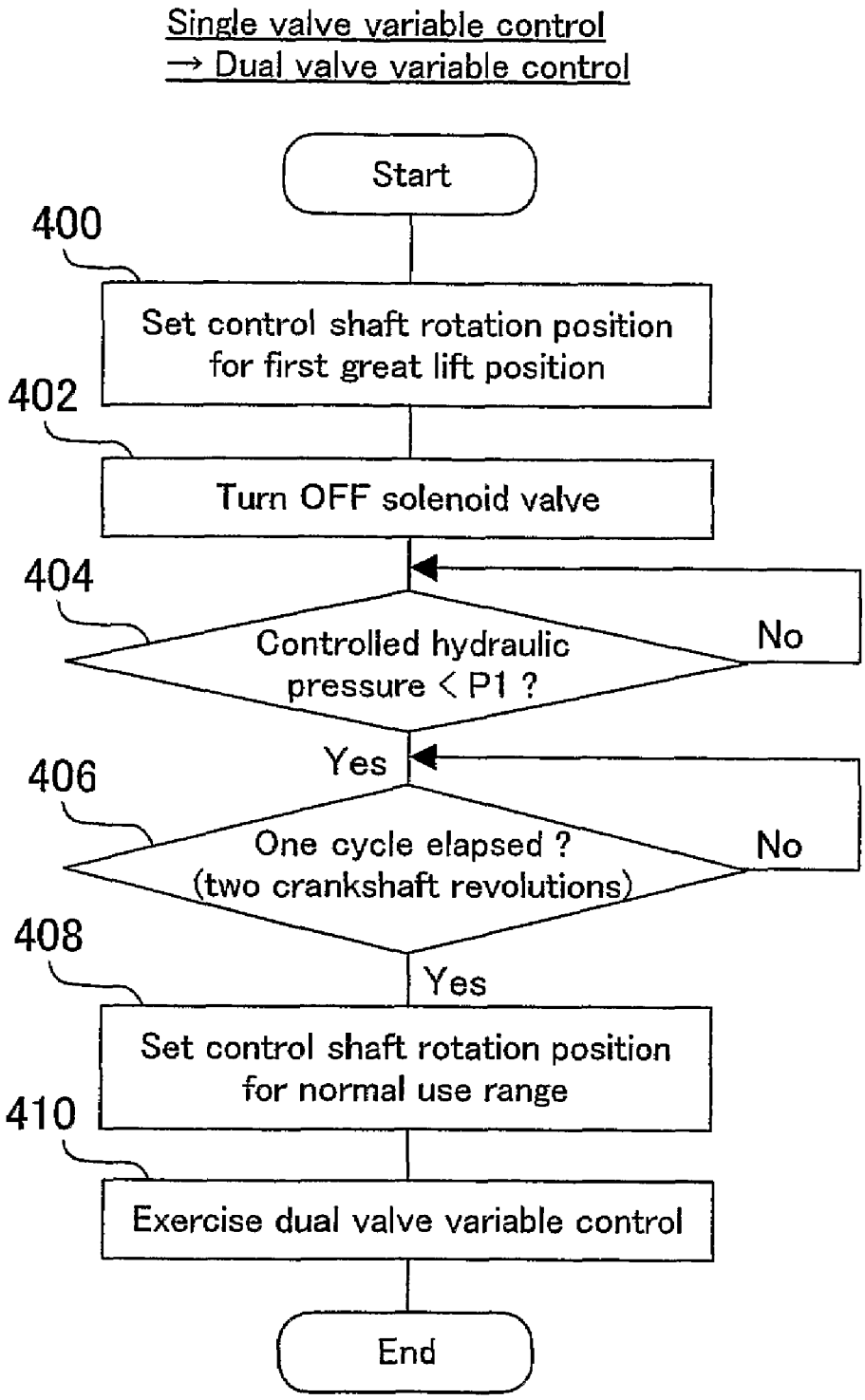
FIG. 19 is a flowchart illustrating a hydraulic control routine that is executed in the second embodiment of the present invention to switch from single valve variable control to dual valve variable control.

FIGS. 18 and 19 are flowcharts illustrating the specific details of hydraulic control that is exercised by the variable valve-operating device according to the present embodiment. The flowchart in FIG. 18 shows a hydraulic control routine that is executed to switch from dual valve variable control to single valve variable control. The flowchart in FIG. 19 shows a hydraulic control routine that is executed to switch from single valve variable control to dual valve variable control.

If an instruction for single valve variable control is issued to the controller for the variable valve-operating device while dual valve variable control is exercised, the controller for the variable valve-operating device executes the routine shown in FIG. 18 to exercise hydraulic control. In the first step (step 300), the control shaft 32 rotates to move the position of the second roller 62R on the slide surface 46R toward the great lift side and change the swing angle of the second swing cam arm 40R so as to place the pin hole 86 at the "second great lift position."

In the next step (step 302), the solenoid valve 112 turns ON to start to supply the hydraulic oil into the oil path 94 while the rotation position of the control shaft 32 is maintained at the position set in step 300. After the solenoid valve 112 is turned ON, step 304 is performed to judge whether the predetermined pressure P1 is reached by the hydraulic pressure (controlled hydraulic pressure) of the hydraulic oil flow in the oil path 94. No subsequent step is performed until the hydraulic pressure reaches the predetermined pressure P1. A standby state persists until the judgment result obtained in step 304 indicates that the predetermined pressure P1 is reached.

When the hydraulic pressure reaches the predetermined pressure P1, the control shaft 32 rotates to further shift the position of the second roller 62R on the slide surface 46R toward the great lift side and change the swing angle of the second swing cam arm 40R so as to place the pin hole 86 at the "first great lift position" (step 306). The next step (step 308) is performed to wait until one cycle elapses (the crankshaft makes two revolutions) while the rotation position of the control shaft 32 is maintained at the position set in step 306. When the second swing cam arm 40R swings to the above swing angle, the pin hole 86 passes the "first great lift position" without fail before the elapse of one cycle. In such an instance, the position of the pin 80 coincides with that of the pin hole 86 so that the hydraulic pressure in the hydraulic chamber 88 generates a driving force to promptly insert the pin 80 into the pin hole 86. This ensures that the great lift arm 72 is completely coupled to the second swing cam arm 40R.

After the elapse of one cycle, the control shaft 32 rotates in a direction opposite to the rotation direction employed in step 306 until the rotation position of the control shaft 32 reverts to the normal use range (step 310). The second roller 62R then completely leaves the slide surface 46R of the second swing cam arm 40R, thereby allowing the second drive cam 24 to drive the second swing cam arm 40R. Consequently, the second valve 4R is set for a fixed lift amount and valve timing. On the other hand, the first swing cam arm 40L is driven by the first drive cam 22 as is the case with the dual valve variable control mode so that variable control can be exercised over the lift amount and valve timing of the first valve 4L by rotating the control shaft 32. Subsequently, the controller exercises single valve variable control over the variable valve-operating device (step 312).

If an instruction for dual valve variable control is issued to the controller for the variable valve-operating device while single valve variable control is exercised, the controller for the variable valve-operating device executes the routine shown in FIG. 19 to exercise hydraulic control. In the first step (step 400), the control shaft 32 rotates beyond the normal use range and toward the great lift side to adjust its rotation position to a position that corresponds to the "first great lift position."

In the next step (step 202), the solenoid valve 112 turns OFF to shut off the hydraulic oil supply to the oil path 94. After the solenoid valve 112 is turned OFF, step 404 is performed to judge whether the hydraulic pressure of a hydraulic oil flow in the oil path 94 (controlled hydraulic pressure) is lower than the predetermined pressure P1. No subsequent step is performed until the hydraulic pressure drops below the predetermined pressure P1. A standby state persists until the judgment result obtained in step 404 indicates that the hydraulic pressure of the hydraulic oil flow in the oil path 94 is lower than the predetermined pressure P1.

When the hydraulic pressure drops below the predetermined pressure P1, step 406 is performed to wait until one cycle elapses (the crankshaft makes two revolutions) while the rotation position of the control shaft 32 is maintained at the position set in step 400. Since the hydraulic pressure is lower than the predetermined pressure P1, the piston 82 pushes the pin 80 out of the pin hole 86. The pin 80 leaves the pin hole 86 before the elapse of one cycle. This completely uncouples the great lift arm 72 from the second swing cam arm 40R.

After the elapse of one cycle, the control shaft 32 rotates in a direction opposite to the rotation direction employed in step 400 until the rotation position of the control shaft 32 reverts to the normal use range (step 408). This brings the second roller 62R into contact with the slide surface 46R of the second swing cam arm 40R again. The second swing cam arm 40R is then driven by the first drive cam 22 as is the case with the first swing cam arm 40L. In other words, when the control shaft 32 rotates, variable control can be exercised over the lift amount and valve timing of the two valves 4L, 4R. Subsequently, the controller exercises dual valve variable control over the variable valve-operating device (step 410).

Other

While the present invention has been described in terms of preferred embodiments, it should be understood that the invention is not limited to the foregoing preferred embodiments, and that variations may be made without departure from the scope and spirit of the invention. For example, the following modifications may be made to the preferred embodiments of the present invention.

In the foregoing embodiments, the great lift arm 72 is provided with the pin 80, and the second swing cam arm 40R is provided with the pin hole 86. However, an alternative is to provide the great lift arm 72 with the pin hole 86 and the second swing cam arm 40R with the pin 80. Further, the foregoing embodiments use hydraulic pressure to drive the pin 80. However, electromagnetic force or other driving force may alternatively be used.

In the foregoing embodiments, the control arm 50 is mounted on the camshaft 20 in a swingable manner, and interlocked with the control shaft 32 via the small-diameter gear 34 and large-diameter gear 52. Alternatively, however, the control arm 50 may be fastened to the control shaft 32 so that the control arm 50 and control shaft 32 rotate as an assembly. The control arm 50 may be coupled to the rollers 60, 62 via the intermediate arm that is mounted on the control arm in a swingable manner. Even when such an alternative configuration is employed, the rollers 60, 62 can be moved along the circumferential surface of the first drive cam 22 in accordance with the rotation of the control shaft 32.

In the foregoing embodiments, the present invention is applied to a one-cam two-valve drive type valve-operating device. However, the present invention can alternatively be applied to a one-cam one-valve drive type valve-operating device. Further, the present invention can be applied to a direct acting or other valve-operating device as well as to a rocker arm type valve-operating device, which is described in conjunction with the foregoing embodiments.

The invention claimed is:

1. A variable valve-operating device comprising:

a first valve and a second valve aligned with each other and positioned on the intake side or the exhaust side of a cylinder in an internal combustion engine;

a first drive cam installed over a camshaft;

a control shaft positioned parallel with the camshaft and being capable of changing the rotation position continuously or stepwise;

a first swing cam arm provided for the first valve to swing around the control shaft;

a second swing cam arm provided for the second valve and being capable of swinging independently of the first swing cam arm;

swing cam surfaces formed on the first swing cam arm and the second swing arm, and coming into contact with a valve support member, which supports the first valve and the second valve, to push the first valve and the second valve in a lifting direction;

slide surfaces formed on the first swing cam arm and the second swing cam arm to face the first drive cam;

an intermediate member sandwiched between the first drive cam and the slide surfaces of the first swing cam arm and of the second swing cam arm, and coming into contact with a circumferential surface of the first drive cam;

a first pushing means for pushing the first swing cam arm in the circumferential direction of the control shaft so as to press the slide surface of the first swing cam arm against the intermediate member;

a second pushing means for pushing the second swing cam arm in the circumferential direction of the control shaft so as to press the slide surface of the second swing cam arm against the intermediate member;

an interlock mechanism for moving the intermediate member along the circumferential surface of the first drive cam in coordination with the rotation of the control shaft to change the position of the intermediate member in relation to the center of the camshaft;

a second drive cam installed over the camshaft so as to be aligned with the first drive cam;

an input arm installed over the control shaft in a rotatable manner, positioned adjacent to the second swing cam arm, and swinging upon receipt of a driving force input from the second drive cam; and coupling means for coupling the second swing cam arm to the input arm.

2. The variable valve-operating device according to claim 1, wherein a setting for the lift amount of the second valve that is obtained when the second drive cam swings the second swing cam arm while the second swing cam arm and the input arm are coupled by the coupling means is not smaller than a maximum lift amount setting for a situation where the first drive cam swings the second swing cam arm.

3. The variable valve-operating device according to claim 1, wherein the coupling means couples the second swing cam arm and the input arm when an insertable pin provided for either the second swing cam arm or the input arm is inserted into a pin hole in the mating arm; and wherein the positions of the pin hole and the pin coincide with each other when the control shaft rotates beyond a normal use range and toward a great lift side in a situation where the second swing cam arm and the input arm are not coupled.

4. The variable valve-operating device according to claim 3, wherein the positions of the pin hole and the pin coincide with each other while the second swing cam arm is a zero lift position in which the second valve does not lift.

5. The variable valve-operating device according to claim 1, wherein the coupling means couples the second swing cam arm and the input arm when an insertable pin provided for either the second swing cam arm or the input arm is inserted into a pin hole in the mating arm; and wherein the position of the pin can be aligned with the position of the pin hole while a driving force for the pin, which is supplied to the pin before coupling of the second swing cam arm and the input arm, is maintained.

6. The variable valve-operating device according to claim 5, further comprising:

an oil path for supplying drive hydraulic oil to the pin provided in the control shaft; and a discharge valve for discharging the hydraulic oil from the oil path;

wherein the oil path doubles as a lubricating oil path for supplying lubricating oil between the control shaft and the swing cam arms and/or the input arm; and wherein the discharge valve is normally closed, opened when the pin is extracted from the pin hole to uncouple the second swing cam arm and the input arm, and closed again when the position of the pin is displaced from the position of the pin hole.

7. The variable valve-operating device according to claim 5, further comprising:

an oil path for supplying drive hydraulic oil to the pin provided in the control shaft; and an open/close valve for opening/closing the oil path;

wherein the open/close valve is normally closed, opened when the pin is inserted into the pin hole to couple the swing cam arm and the input arm, and closed again when the pin is extracted from the pin hole to uncouple the second swing cam arm and the input arm.

8. A variable valve-operating device comprising:

a first valve and a second valve aligned with each other and positioned on the intake side or the exhaust side of a cylinder in an internal combustion engine;

a first drive cam installed over a camshaft;

a control shaft positioned parallel with the camshaft and being capable of changing the rotation position continuously or stepwise;

a first swing cam arm provided for the first valve to swing around the control shaft;

a second swing cam arm provided for the second valve and being capable of swinging independently of the first swing cam arm;

swing cam surfaces formed on the first swing cam arm and the second swing arm, and coming into contact with a valve support member, which supports the first valve and the second valve, to push the first valve and the second valve in a lifting direction;

slide surfaces formed on the first swing cam arm and the second swing cam arm to face the first drive cam;

an intermediate member sandwiched between the first drive cam and the slide surfaces of the first swing cam arm and of the second swing cam arm, and coming into contact with a circumferential surface of the first drive cam;

a first pushing device for pushing the first swing cam arm in the circumferential direction of the control shaft so as to press the slide surface of the first swing cam arm against the intermediate member;

a second pushing device for pushing the second swing cam arm in the circumferential direction of the control shaft so as to press the slide surface of the second swing cam arm against the intermediate member;

an interlock mechanism for moving the intermediate member along the circumferential surface of the first drive cam in coordination with the rotation of the control shaft to change the position of the intermediate member in relation to the center of the camshaft;

a second drive cam installed over the camshaft so as to be aligned with the first drive cam;

an input arm installed over the control shaft in a rotatable manner, positioned adjacent to the second swing cam arm, and swinging upon receipt of a driving force input from the second drive cam; and a coupling device for coupling the second swing cam arm to the input arm.

* * * * *